US005234512A

United States Patent [19]

Inoue et al.

[11] Patent Number: 5,234,512

[45] Date of Patent: Aug. 10, 1993

[54] FE-NI ALLOY SHEET FOR SHADOW MASK, EXCELLENT IN ETCHING PIERCEABILITY, PREVENTING STICKING DURING ANNEALING, AND INHIBITING PRODUCTION OF GASES

[75] Inventors: Tadashi Inoue; Masayuki Kinoshita; Tomoyoshi Okita, all of Tokyo, Japan

[73] Assignee: NKK Corporation, Tokyo, Japan

[21] Appl. No.: 754,386

[22] Filed: Sep. 3, 1991

[30] Foreign Application Priority Data

Oct. 31, 1990 [JP] Japan ..... 2-291788

[51] Int. Cl.[5] ..... C21D 7/00

[52] U.S. Cl. ..... 148/541; 148/546; 148/621; 148/336; 420/94

[58] Field of Search ..... 148/12 E, 12 A, 336, 148/2, 541, 546, 605; 420/94

[56] References Cited

FOREIGN PATENT DOCUMENTS 48-78017 10/1973 Japan .
2-170922 7/1990 Japan .
2-182828 7/1990 Japan .

*Primary Examiner*—R. Dean
*Assistant Examiner*—Sikyin Ip
*Attorney, Agent, or Firm*—Frishauf, Holtz, Goodman & Woodward

[57] ABSTRACT

An Fe-Ni alloy sheet for a shadow mask excellent in etching pierceability, preventing sticking during annealing, and inhibiting production of gases, which consists essentially of:

| | |
|---|---|
| nickel (Ni) | from 34 to 38 wt. %, |
| silicon (Si) | from 0.01 to 0.09 wt. %, |
| aluminum (Al) | from 0.002 to 0.020 wt. %, |
| calcium (Ca) | from 0.0002 to 0.0020 wt. %, |
| magnesium (Mg) | from 0.0003 to 0.0020 wt. %, |
| where, Ca + ½ Mg | from 0.0005 to 0.0025 wt. %, |

and the balance being iron and incidental impurities, where, the contents of carbon (C), nitrogen (N), sulfur (S), oxygen (O) and phosphorus (P) as the incidental impurities being respectively:

up to 0.0050 wt.% for carbon,
up to 0.0020 wt.% for nitrogen,
up to 0.0020 wt.% for sulfur,
up to 0.0040 wt.% for oxygen, and
up to 0.0040 wt.% for phosphorus, where, 1/10 C+1/10 N+S+1/5 O+½P: up to 0.0045 wt.%, and Ca+½ Mg≧S+1/5 O; and the surface portion of the Fe-Ni alloy sheet having a silicon (Si) segregation rate, as expressed by the following formula, of up to 10%:

$$\left|\frac{\left(\begin{matrix}\text{Si concentration in}\\ \text{segregation region}\end{matrix}\right)-\left(\begin{matrix}\text{average Si}\\ \text{concentration}\end{matrix}\right)}{\text{(Average si concentration)}}\right| \times 100.$$

6 Claims, 6 Drawing Sheets

FE-NI ALLOY SHEET FOR SHADOW MASK, EXCELLENT IN ETCHING PIERCEABILITY, PREVENTING STICKING DURING ANNEALING, AND INHIBITING PRODUCTION OF GASES

REFERENCE TO PATENTS, APPLICATIONS AND PUBLICATIONS PERTINENT TO THE INVENTION

As far as we know, there are available the following prior art documents pertinent to the present invention:

(1) Japanese Patent Provisional Publication No. 2-170,922 dated Jul. 2, 1990; and (2) Japanese Patent Provisional Publication No. 2-182,828 dated Jul. 17, 1990.

The contents of the prior arts disclosed in the above-mentioned prior art documents will be discussed hereafter under the heading of the "BACKGROUND OF THE INVENTION".

BACKGROUND OF THE INVENTION

1. Field of the Invention

The present invention relates to an Fe-Ni alloy sheet for a shadow mask used for a color cathode-ray tube and a method for manufacturing same.

2. Related Art Statement

Along with the recent tendency toward a higher-grade color television set, an Fe-Ni alloy containing nickel of from 34 to 38 wt.% (hereinafter referred to as the "conventional Fe-Ni alloy") is used as an alloy for a shadow mask capable of coping with problems such as a color-phase shift. The conventional Fe-Ni alloy has a far smaller thermal expansion coefficient as compared with a low-carbon steel conventionally applied as a material for a shadow mask.

By manufacturing a shadow mask from the conventional Fe-Ni alloy, therefore, even heating of the shadow mask by an electron beam would hardly cause such problems as a color-phase shift resulting from thermal expansion of the shadow mask.

An alloy sheet for a shadow mask is usually manufactured by the following steps of: preparing an alloy ingot by a continuous casting or by an ingot casting, subjecting the thus prepared alloy ingot to a slabbing rolling, a hot rolling and a cold rolling, thereby manufacturing an alloy sheet.

The alloy sheet for a shadow mask manufactured as above is processed into a shadow mask by the following steps of: forming passage-holes for the electron beam (hereinafter simply referred to as the "holes") in the alloy sheet for a shadow mask by the photoetching (an alloy sheet for a shadow mask as pierced by the etching is hereinafter referred to as the "flat mask"), then subjecting the flat mask to an annealing, then press-forming the annealed flat mask into a curved surface to match with the shape of a cathode-ray tube, and applying a blackening treatment to the surface thereof.

However, the use of the conventional Fe-Ni alloy poses the following problems:

(1) The conventional Fe-Ni alloy, containing nickel in a large quantity, has a strength higher than that of the low-carbon steel. In order to improve press-formability, therefore, a flat mask manufactured from the conventional Fe-Ni alloy must be annealed at a higher temperature than in the case of a flat mask manufactured from the low-carbon steel. Sticking therefore tends to occur in several tens to several hundreds of flat masks made from the conventional Fe-Ni alloy, which are placed one on the top of the other, during the annealing thereof.

(2) In the alloy sheet for a shadow mask manufactured from the conventional Fe-Ni alloy, irregularities may easily occur in the diameter and the shape of the holes pierced by the etching as a result of the segregation of components, as compared with the sheet for a shadow mask manufactured from the low-carbon steel. Irregularities in the hole diameter and the hole shape seriously impair the quality of a color cathode-ray tube.

(3) In a shadow mask manufactured from the conventional Fe-Ni alloy, when the shadow mask is heated by the radiation of an electron beam during the operation of the color cathode-ray tube, gases tend to be produced from the surface of the shadow mask. The production of gases from the surface of the shadow mask seriously impairs the quality of a color cathode-ray tube.

(4) Because of the very low hot workability, the conventional Fe-Ni alloy is susceptible to flaws during a slabbing rolling and a hot rolling, this requiring a large amount of scarfing, leading to a very low production yield.

For the purpose of solving the above-mentioned problems, the following prior arts are known:

(a) Japanese Patent Provisional Publication No. 2-170,922 discloses a method which comprises the steps of: applying a soaking treatment, prior to a hot rolling, to a slab prepared by the continuous casting of an Fe-Ni alloy containing nickel of from 30 to 50 wt.%, in a heating furnace capable of controlling the oxygen concentration to a low level, at a temperature within a range of from 1,200° to 1,350° C. for at least one hour to reduce segregation of nickel and manganese in the slab, thereby inhibiting the production of irregularities in the diameter and the shape of the holes pierced by the etching, caused by a string-like pattern along the rolling direction under the effect of the segregation of the components, and preventing the production of subscale, thus improving the production yield (hereinafter referred to as the "prior art 1").

(b) Japanese Patent Provisional Publication No. 2-182,828 discloses a method which comprises the steps of: heating an ingot of an Fe-Ni alloy containing nickel of from 30 to 80 wt.% and boron of from 0.001 to 0.030 wt.% to a temperature of at least 900° C., forging same with a sectional reduction rate of at least 30% to prepare a slab, and then applying a soaking treatment to the thus prepared slab at a temperature of at least 1,000° C. for at least one hour, thereby inhibiting the production of irregularities in the diameter and the shape of the holes pierced by the etching, caused by a string-like pattern along the rolling direction under the effect of the segregation of the components (hereinafter referred to as the "prior art 2").

The prior arts 1 and 2, while permitting inhibition of the production of irregularities in the diameter and the shape of the holes pierced by the etching, have still the following problems: The surface of each hole pierced by the etching is seriously roughened to present a blurred periphery; sticking of the flat masks during the annealing thereof cannot be prevented; when the shadow mask is heated by the radiation of an electron beam during the operation of the color cathode-ray tube, gases tend to be produced from the surface of the shadow mask; and improvement of the production yield is insufficient.

More specifically, in the prior art 1, although it is possible to inhibit the production of irregularities in the diameter and the shape of the holes pierced by the etching, caused by a string-like pattern along the rolling direction under the effect of the segregation of nickel and manganese, by reducing the segregation of nickel and manganese in the slab through application of the soaking treatment to the slab, silicon segregation cannot be sufficiently reduced. The segregation of silicon in an Fe-Ni alloy remains in the final product more easily than the segregation of nickel and manganese. While the segregation of nickel and manganese is reduced, in the prior art 1, by applying the soaking treatment to the slab as described above, it is impossible in this manner to reduce the segregation of silicon to below a certain level. In the prior art 1, as a result, sticking of the flat masks occurs during the annealing thereof because of the serious segregation of silicon.

With a considerable segregation of silicon, furthermore, the surface of each hole pierced by the etching is seriously roughened to present a blurred periphery, thus producing another etching piercing defect, different from the above-mentioned etching piercing defect caused by the segregation of nickel and manganese, and, as a result, the quality of the color cathode-ray tube is degraded. In addition, since the soaking treatment is applied to the slab at a temperature within a range of from 1,200° to 1,350° C. for at least one hour, the production of surface flaws of the slab caused by the subscale leads to a lower production yield of the slab even when the oxygen concentration in the heating atmosphere is reduced. In the prior art 1, furthermore, because of the presence of fine cracks in the Fe-Ni alloy sheet, a treatment solution such as an etching solution remains in these fine cracks during the etching-piercing. As a result, when the shadow mask is heated by the radiation of an electron beam during the operation of the color cathode-ray tube, gases tend to be produced from the surface of the shadow mask.

The prior art 2 inhibits the production of irregularities in the diameter and the shape of the holes pierced by the etching, caused by a string-like pattern along the rolling direction under the effect of the segregation of nickel and manganese, by inhibiting the segregation of such impurities as carbon, silicon, manganese and chromium onto the crystal grain boundary through addition of boron to the Fe-Ni alloy, and reducing the segregation of components through the forging. As in the prior art 1, however, the segregation of silicon is not sufficiently reduced. In the prior art 2 also, although the segregation of nickel and manganese in the Fe-Ni alloy is reduced by the addition of boron into the Fe-Ni alloy and the application of forging, it is impossible to reduce the segregation of silicon to below a certain level. As in the prior art 1, as a result, sticking of the flat masks occurs during the annealing thereof because of the serious segregation of silicon, and the surface of each hole pierced by the etching is seriously roughened to present a blurred periphery, thus producing an etching piercing defect.

In the prior art 2, furthermore, application of the forging leads to a lower production yield. In addition, in the prior art 2, heating of the shadow mask by the radiation of an electron beam during the operation of the color cathode-ray tube tends to easily produce gases from the surface of the shadow mask, because of the presence of fine cracks in the Fe-Ni alloy sheet, as in the prior art 1. Furthermore, because boron is added to the Fe-Ni alloy in the prior art 2, the segregation of boron onto the crystal grain boundary occurs to a considerable extent, and the surface of each hole pierced by the etching is seriously roughened, thus producing an etching piercing defect similar to that caused by the considerable segregation of silicon, this heavily imparing the quality of the color cathode-ray tube.

Under such circumstances, there is a strong demand for the development of an Fe-Ni alloy sheet for a shadow mask, which is excellent in etching pierceability, ensures the prevention of sticking of the flat masks during the annealing thereof, inhibits the production of gases from the surface of the shadow mask during the operation of the color cathode-ray tube, and gives a high production yield, and a method for manufacturing same, but such an Fe-Ni alloy sheet and a method for manufacturing same have not as yet been proposed.

SUMMARY OF THE INVENTION

An object of the present invention is therefore to provide an Fe-Ni alloy sheet for a shadow mask, which is excellent in etching pierceability, ensures the prevention of sticking of the flat masks during the annealing thereof, inhibits the production of gases from the surface of the shadow mask during the operation of the color cathode-ray tube, and gives a high production yield, and a method for manufacturing same.

In accordance with one of the features of the present invention, there is provided an Fe-Ni alloy sheet for a shadow mask, which consists essentially of:

| | |
|---|---|
| nickel (Ni) | from 34 to 38 wt. %, |
| silicon (Si) | from 0.01 to 0.09 wt. %, |
| aluminum (Al) | from 0.002 to 0.020 wt. %, |
| calcium (Ca) | from 0.0002 to 0.0020 wt. %, |
| magnesium (Mg) | from 0.0003 to 0.0020 wt. %, |
| where, Ca + ½ Mg | from 0.0005 to 0.0025 wt. %, |

and the balance being iron and incidental impurities, where, the contents of carbon (C), nitrogen (N), sulfur (S), oxygen (0) and phosphorus (P) as said incidental impurities being respectively:

up to 0.0050 wt.% for carbon, up to 0.0020 wt.% for nitrogen, up to 0.0020 wt.% for sulfur, up to 0.0040 wt.% for oxygen, and up to 0.0040 wt.% for phosphorus, where, $1/10\ C+1/10\ N+S+1/5\ O+\frac{1}{2}P$: up to 0.0045 wt.%, and $Ca+\frac{1}{2}Mg \geqq S+\frac{1}{2}O$; and the surface portion of said Fe-Ni alloy sheet having a silicon (Si) segregation rate, as expressed by the following formula, of up to 10%:

$$\left| \frac{\left(\begin{matrix}\text{Si concentration in}\\ \text{segregation region}\end{matrix}\right) - \left(\begin{matrix}\text{average Si}\\ \text{concentration}\end{matrix}\right)}{(\text{Average si concentration})} \right| \times 100.$$

In accordance with another one of the features of the present invention, there is provided an Fe-Ni alloy sheet for a shadow mask, which consists essentially of:

| | |
|---|---|
| nickel (Ni) | from 34 to 38 wt. %, |
| silicon (Si) | from 0.01 to 0.09 wt. %, |
| aluminum (Al) | from 0.002 to 0.020 wt. %, |
| calcium (Ca) | from 0.0002 to 0.0020 wt. %, |

-continued

| | |
|---|---|
| magnesium (Mg) | from 0.0003 to 0.0020 wt. %, |
| where, Ca + ½ Mg | from 0.0005 to 0.0025 wt. %, |

and the balance being iron and incidental impurities, where, the contents of carbon (C), nitrogen (N), sulfur (S), oxygen (O), phosphorus (P) and non-metallic inclusions as said incidental impurities being respectively:

up to 0.0050 wt.% for carbon, up to 0.0020 wt.% for nitrogen, up to 0.0020 wt.% for sulfur, up to 0.0040 wt.% for oxygen, up to 0.0040 wt.% for phosphorus, and up to 0.0040 wt.% as converted into oxygen for non-metallic inclusions, where, $1/10\ C+1/10\ N+S+1/5\ O+\frac{1}{2}\ P$: up to 0.0045 wt.%, and $Ca+\frac{1}{2}\ Mg \geqq S+\frac{1}{2}\ O$;

said non-metallic inclusions as said incidental impurities comprising a composition having a particle size of up to 6 μm in a region of a melting point of at least 1,600° C., which region is defined by the liquidus curve of 1,600° C. in the $CaO\text{-}Al_2O_3\text{-}Mgo$ ternary phase diagram; and the surface portion of said alloy sheet having a silicon (Si) segregation rate, as expressed by the following formula, of up to 10%:

$$\left|\frac{\left(\begin{matrix}\text{Si concentration in}\\ \text{segregation region}\end{matrix}\right)-\left(\begin{matrix}\text{average Si}\\ \text{concentration}\end{matrix}\right)}{(\text{Average si concentration})}\right| \times 100.$$

In accordance with further another one of the features of the present invention, there is provided a method for manufacturing an Fe-Ni alloy sheet for a shadow mask, which comprises the steps of:

preparing an ingot or a continuously cast slab of an Fe-Ni alloy consisting essentially of:

| | |
|---|---|
| nickel (Ni) | from 34 to 38 wt. %, |
| silicon (Si) | from 0.01 to 0.09 wt. %, |
| aluminum (Al) | from 0.002 to 0.020 wt. %, |
| calcium (Ca) | from 0.0002 to 0.0020 wt. %, |
| magnesium (Mg) | from 0.0003 to 0.0020 wt. %, |
| where, Ca + ½ Mg | from 0.0005 to 0.0025 wt. %, |

and the balance being iron and incidental impurities, where, the contents of carbon (C), nitrogen (N), sulfur (S), oxygen (0) and phosphorus (P) as said incidental impurities being respectively:

up to 0.0050 wt.% for carbon, up to 0.0020 wt.% for nitrogen, up to 0.0020 wt.% for sulfur, up to 0.0040 wt.% for oxygen, and up to 0.0040 wt.% for phosphorus, where, $1/10\ C+1/10\ N+S+1/5\ O+\frac{1}{2}\ P$: up to 0.0045 wt.%, and $Ca+\frac{1}{2}\ Mg \geqq S+1/5\ O$;

subjecting said ingot or said continuously cast slab to a slabbing rolling, a scarfing, a hot rolling, a descaling, another scarfing, at least one cold rolling accompanied by a recrystallization annealing, a temper rolling and a stress-relieving annealing in this order to prepare a sheet of said Fe-Ni alloy;

heating said ingot or said continuously cast slab, when subjecting same to said slabbing rolling, in a heating atmosphere having a hydrogen sulfide ($H_2S$) concentration of up to 100 ppm to a temperature (T)(° C.) within a range of from 1,150° to 1,300° C. for a period of time (t)(hr) as expressed by the following formula:

$$7.71-5.33\times10^{-3}T \leqq \log t \leqq 8.00-5.33\times10^{-3}T,$$

then, subjecting same to said slabbing rolling at a sectional reduction rate of at least 35%, and then slowly cooling same, thereby adjusting a silicon (Si) segregation rate, as expressed by the following formula, of the surface portion of said Fe-Ni alloy sheet to up to 10%:

$$\left|\frac{\left(\begin{matrix}\text{Si concentration in}\\ \text{segregation region}\end{matrix}\right)-\left(\begin{matrix}\text{average Si}\\ \text{concentration}\end{matrix}\right)}{(\text{Average si concentration})}\right| \times 100.$$

The above-mentioned slabbing rolling may comprise the steps of:

heating said ingot or said continuously cast slab in a heating atmosphere having a hydrogen sulfide ($H_2S$) concentration of up to 100 ppm to a temperature (T) (° C.) within a range of from 1,150° to 1,300° C. for a period of time (t)(hr) as expressed by the following formula:

$$7.40-5.33\times10^{-3}T \leqq \log t \leqq 7.71-5.33\times10^{-3}T;$$

then subjecting same to a primary slabbing rolling as part of said slabbing rolling at a sectional reduction rate within a range of from 20 to 70%, then heating same again in a heating atmosphere having a hydrogen sulfide ($H_2S$) concentration of up to 100 ppm to a temperature (T)(° C.) within a range of from 1,150° to 1,300° C. for a period of time (t)(hr) as expressed by the above-mentioned formula, then subjecting same to a secondary slabbing rolling as part of said slabbing rolling at a sectional reduction rate within a range of from 20 to 70%, and then slowly cooling same, thereby adjusting a silicon (Si) segregation rate, as expressed by the following formula, of the surface portion of said Ni-Fe alloy sheet to up to 10%:

$$\left|\frac{\left(\begin{matrix}\text{Si concentration in}\\ \text{segregation region}\end{matrix}\right)-\left(\begin{matrix}\text{average Si}\\ \text{concentration}\end{matrix}\right)}{(\text{Average si concentration})}\right| \times 100.$$

In accordance with further another one of the features of the present invention, there is provided a method for manufacturing an Fe-Ni alloy sheet for a shadow mask, which comprises the steps of:

preparing an ingot or a continuously cast slab of an Fe-Ni alloy consisting essentially of:

| | |
|---|---|
| nickel (Ni) | from 34 to 38 wt. %, |
| silicon (Si) | from 0.01 to 0.09 wt. %, |
| aluminum (Al) | from 0.002 to 0.020 wt. %, |
| calcium (Ca) | from 0.0002 to 0.0020 wt. %, |
| magnesium (Mg) | from 0.0003 to 0.0020 wt. %, |

-continued

| | |
|---|---|
| where, Ca + ½ Mg | from 0.0005 to 0.0025 wt. %, |

and the balance being iron and incidental impurities, where, the contents of carbon (C), nitrogen (N), sulfur (S), oxygen (O), phosphorus (P) and non-metallic inclusions as said incidental impurities being respectively:

up to 0.0050 wt.% for carbon, up to 0.0020 wt.% for nitrogen, up to 0.0020 wt.% for sulfur, up to 0.0040 wt.% for oxygen, up to 0.0040 wt.% for phosphorus, and up to 0.0040 wt.% as converted into oxygen for non-metallic inclusions, where, 1/10 C+1/10 N+S+1/5 O+½ P: up to 0.0045 wt.%, and Ca+½ Mg≧S+1/5 O;

said non-metallic inclusions as said incidental impurities comprising a composition having a particle size of up to 6 μm in a region of a melting point of at least 1,600° C., which region is defined by the liquidus curve of 1,600° C. in the $CaO$-$AlO_3$-$MgO$ ternary phase diagram;

subjecting said ingot or said continuously cast slab to a slabbing rolling, a scarfing, a hot rolling, a descaling, another scarfing, at least one cold rolling accompanied by a recrystallization annealing, a temper rolling and a stress-relieving annealing in this order to prepare a sheet of said Fe-Ni alloy;

heating said ingot or said continuously cast slab, when subjecting same to said slabbing rolling, in a heating atmosphere having a hydrogen sulfide ($H_2S$) concentration of up to 100 ppm to a temperature (T)(° C.) within a range of from 1,150° to 1,300° C. for a period of time (t)(hr) as expressed by the following formula:

$$7.71-5.33\times10^{-3}T \leqq \log t \leqq 8.00-5.33\times10^{-3}T,$$

then, subjecting same to said slabbing rolling at a sectional reduction rate of at least 35%, and then slowly cooling same, thereby adjusting a silicon (Si) segregation rate, as expressed by the following formula, of the surface portion of said Fe-Ni alloy sheet to up to 10%:

$$\left|\frac{\left(\begin{matrix}\text{Si concentration in}\\ \text{segregation region}\end{matrix}\right)-\left(\begin{matrix}\text{average Si}\\ \text{concentration}\end{matrix}\right)}{\text{(Average si concentration)}}\right|\times 100.$$

The above-mentioned slabbing rolling may comprise the steps of:

heating said ingot or said continuously cast slab in a heating atmosphere having a hydrogen sulfide ($H_2S$) concentration of up to 100 ppm to a temperature (T)(° C.) within a range of from 1,150° to 1,300° C. for a period of time (t)(hr) as expressed by the following formula:

$$7.40-5.33\times10^{-3}T \leqq \log t \leqq 7.71-5.33\times10^{-3}T;$$

then subjecting same to a primary slabbing rolling as part of said slabbing rolling at a sectional reduction rate within a range of from 20 to 70%, then heating same again in a heating atmosphere having a hydrogen sulfide ($H_2S$) concentration of up to 100 ppm to a temperature (T) (° C.) within a range of from 1,150° to 1,300° C. for a period of time (t)(hr) as expressed by the above-mentioned formula, then subjecting same to a secondary slabbing rolling as part of said slabbing rolling at a sectional reduction rate within a range of from 20 to 70%, and then slowly cooling same, thereby adjusting a silicon (Si) segregation rate, as expressed by the following formula, of the surface portion of said Fe-Ni alloy sheet to up to 10%:

$$\left|\frac{\left(\begin{matrix}\text{Si concentration in}\\ \text{segregation region}\end{matrix}\right)-\left(\begin{matrix}\text{average Si}\\ \text{concentration}\end{matrix}\right)}{\text{(Average si concentration)}}\right|\times 100.$$

DETAILED DESCRIPTION OF PREFERRED EMBODIMENTS

Figure 1:
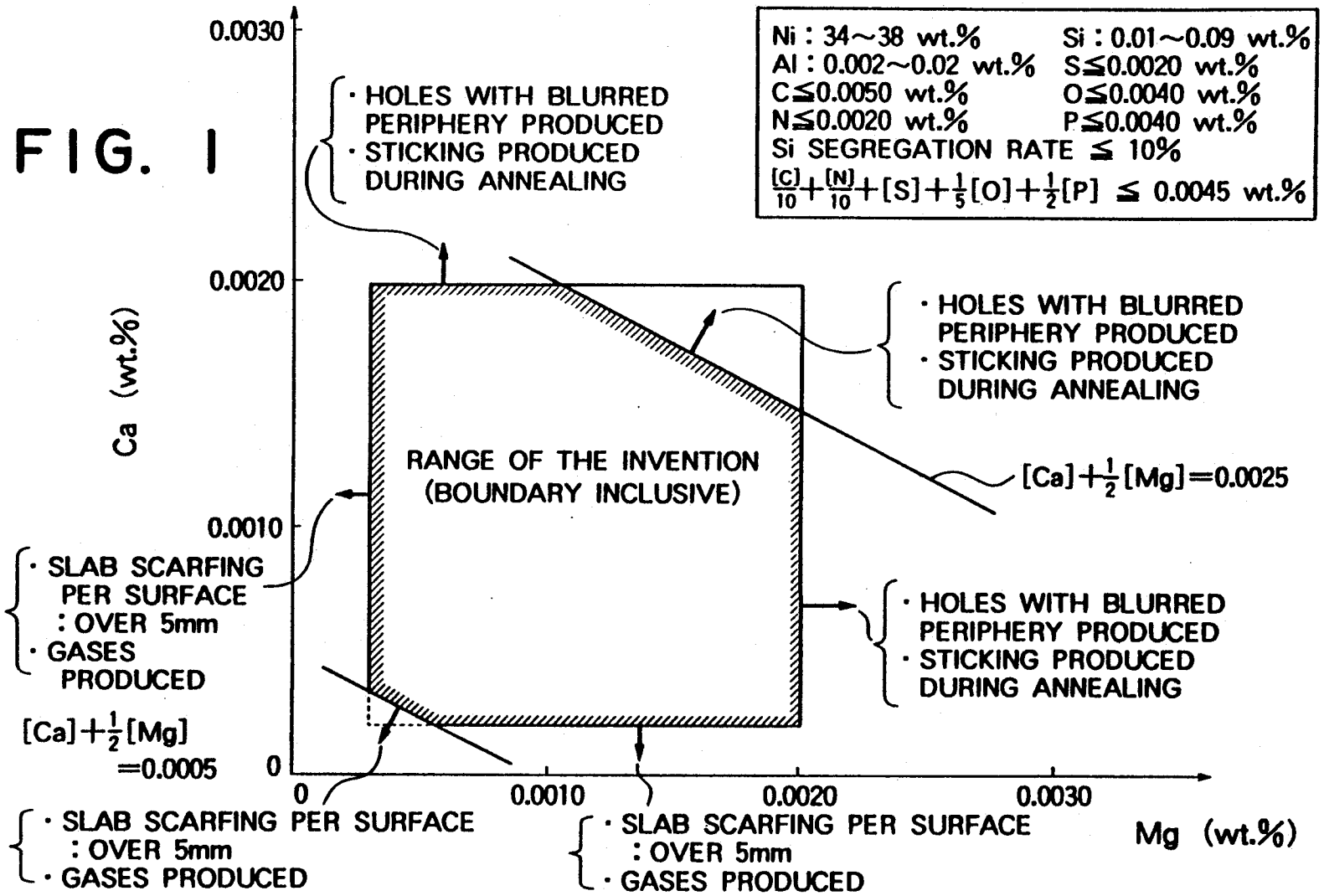
FIG. 1 is a graph illustrating, when changing the contents of calcium and magnesium, respectively, in a slab and a sheet each comprising an Fe-Ni alloy having a chemical composition within the scope of the present invention except for the contents of calcium and magnesium, the effect of each of the contents of calcium and magnesium, on the amount of slab scarfing, etching pierceability of the Fe-Ni alloy sheet, sticking of the flat masks during the annealing thereof, and the production of gases from the surface of the shadow mask during the operation of the color cathode-ray tube.

From the above-mentioned point of view, extensive studies were carried out to develop an Fe-Ni alloy sheet for a shadow mask, which is excellent in etching pierceability, ensures the prevention of sticking of the flat masks during the annealing thereof, inhibits the production of gases from the surface of the shadow mask during the operation of the color cathode-ray tube, and gives a high production yield.

As a result, the following findings were obtained: It is possible to obtain an Fe-Ni alloy sheet for a shadow mask, which is excellent in etching pierceability, ensures the prevention of sticking of the flat masks during the annealing thereof, inhibits the production of gases from the surface of the shadow mask during the operation of the color cathode-ray tube, and gives a high production yield, by adjusting the chemical composition and the silicon segregation rate of the Fe-Ni alloy sheet for a shadow mask within prescribed ranges. More specifically, by limiting the contents of silicon and sulfur and the silicon segregation rate within prescribed ranges, it is possible to inhibit the segregation of silicon onto the dendritic crystal grain boundery so as to prevent the occurrence of the etching piercing defect, in which the surface of each hole pierced by the etching is seriously roughened to present a blurred periphery under the effect of a large segregation of silicon, and to ensure the prevention of sticking of the flat masks during the annealing thereof. In addition, by limiting the contents of impurities such as carbon, nitrogen, sulfur, oxygen and phosphorus and the constituent elements such as aluminum, calcium and magnesium within prescribed ranges, it is possible to prevent the production of irregularities in the diameter and the shape of the holes pierced by the etching, to improve hot workability of the Fe-Ni alloy so as to minimize the occurrence of surface flaws of the slab during the slabbing rolling, and to inhibit the occurrence of fine inner cracks of the slab during the slabbing rolling. Thus, the production yield is improved by reducing the production of the surface flaws of the slab during the slabbing rolling, and a treatment solution such as an etching solution is prevented from remaining in the Fe-Ni alloy sheet by inhibiting the occurrence of the fine inner cracks of the slab during the slabbing rolling, thereby inhibiting the production of gases from the surface of the shadow mask. Furthermore, it is possible to improve etching pierceability of the Fe-Ni alloy sheet by adjusting non-metallic inclusions to a prescribed composition.

The following findings were additionally obtained: The silicon segregation rate can be adjusted within a prescribed range by heating an ingot or a continuously cast slab of the Fe-Ni alloy at a temperature within a prescribed range for a period of time within a prescribed range, and slabbing-rolling same at a sectional reduction rate within a prescribed range.

The present invention was made on the basis of the above-mentioned findings. Now, the Fe-Ni alloy sheet for a shadow mask of the present invention is described further in detail.

The chemical composition of the Fe-Ni alloy sheet for a shadow mask of the present invention is limited within the above-mentioned range for the following reasons.

(1) Nickel

The Fe-Ni alloy sheet for a shadow mask is required to have the upper limit of about $2.0\times10^{-6}/°$ C. of an average thermal expansion coefficient in a temperature region of from 30° to 100° C. in order to prevent the occurrence of a color-phase shift. This thermal expansion coefficient depends upon the nickel content in the Fe-Ni alloy sheet. The nickel content which satisfies the above-mentioned condition of the average thermal expansion coefficient is within a range of from 34 to 38 wt.%. The nickel content should therefore be limited within a range of from 34 to 38 wt.%. When the Fe-Ni alloy sheet contains from 0.01 to 6.00 wt.% cobalt, the nickel content, which satisfy the above-mentioned condition of the average thermal expansion coefficient, is within a range of from 30 to 40 wt.%. Therefore, the nickel content in this case may also be within a range of from 34 to 38 wt.%.

(2) Silicon

Silicon has a function of preventing sticking of the flat masks made of the Fe-Ni alloy sheet for a shadow mask during the annealing thereof, by forming an oxide film mainly comprising silicon, which is effective for the prevention of sticking, on the surface of the flat mask. However, with a silicon content of under 0.01 wt.%, a desired effect as described above is not available. With a silicon content of over 0.09 wt.%, on the other hand, the surface of each hole pierced by the etching is seriously roughened, thus deteriorating etching pierceability of the Fe-Ni alloy sheet. The silicon content should therefore be limited within a range of from 0.01 to 0.09 wt.%.

Even with a silicon content within the above-mentioned range, an excessively high silicon segregation rate of the surface portion of the Fe-Ni alloy sheet for a shadow mask over a prescribed value results in the segregation of silicon onto the dendritic crystal grain boundary, thus locally causing the etching piercing defect in the Fe-Ni alloy sheet, in which each hole pierced by the etching presents a blurred periphery, and in the occurrence of sticking on part of the surface of the flat mask during the annealing thereof. In order to prevent the occurrence of the above-mentioned etching piercing defect and sticking of the flat masks, therefore, it is necessary, in addition to the limitation of the silicon content as described above, to limit a silicon segregation rate, as expressed by the following formula, of the surface portion of the Fe-Ni alloy sheet to up to 10%:

$$\left|\frac{\left(\begin{array}{c}\text{Si concentration in}\\ \text{segregation region}\end{array}\right)-\left(\begin{array}{c}\text{average Si}\\ \text{concentration}\end{array}\right)}{\text{(Average si concentration)}}\right|\times 100.$$

(3) Aluminum

Aluminum is an element which exerts an effect on the amount and the particle size of non-metallic inclusions in the Fe-Ni alloy sheet for a shadow mask. With an aluminum content within a range of from 0.002 to 0.020 wt.%, non-metallic inclusions having a small particle size are produced in a slight amount in the Fe-Ni alloy sheet, so that a piercing defect hardly occurs during etching piercing.

With an aluminum content of under 0.002 wt.%, however, non-metallic inclusions having a large particle size are produced in a large amount in the Fe-Ni alloy sheet, so that a piercing defect tends to occur during etching piercing. An aluminum content of over 0.020 wt.% causes, on the other hand, the formation of a firm oxide film on the surface of the Fe-Ni alloy sheet and thus causes irregularities in the diameter and the shape of the holes pierced by the etching. When the aluminum content is over 0.020 wt.%, furthermore, the improvement of hot workability of the Fe-Ni alloy to be brought about by the addition of calcium in a slight amount is not achieved, with the production of many surface flaws on the slab, leading to a lower production yield, and the production of fine inner cracks in the Fe-Ni alloy sheet, leading to an easy production of gases from the surface of the shadow mask during the operation of the color cathode-ray tube. The aluminum content should therefore be limited within a range of from 0.002 to 0.020 wt.%.

(4) Calcium

Calcium has a function of causing sulfur and oxygen as the incidental impurities to precipitate in the form of stable and non-detrimental substances, and thus improving hot workability of the Fe-Ni alloy. With a calcium content of under 0.0002 wt.%, however, a desired effect as described above is not available, with the production of surface flaws on the slab and fine inner cracks in the Fe-Ni alloy sheet. With a calcium content of over 0.0020 wt.%, on the other hand, a firm oxide film mainly comprising calcium is formed on the surface of the Fe-Ni alloy sheet, this causing sticking of the flat masks during the annealing thereof, and the piercing defect in the Fe-Ni alloy sheet, in which each hole pierced by the etching represents a blurred periphery. The calcium content should therefore be limited within a range of from 0.0002 to 0.0020 wt.%.

(5) Magnesium

As in the case of calcium, magnesium has a function of causing sulfur and oxygen as the incidental impurities to precipitate in the form of stable and non-detrimental substances, and thus improving hot workability of the Fe-Ni alloy. With a magnesium content of under 0.0003 wt.%, however, a desired effect as described above is not available, with the production of surface flaws on the slab and fine inner cracks in the Fe-Ni alloy sheet. With a magnesium content of over 0.0020 wt.%, on the other hand, a firm oxide film mainly comprising magnesium is formed on the surface of the Fe-Ni alloy sheet, this causing sticking of the flat masks during the annealing thereof, and the piercing defect in the Fe-Ni alloy sheet, in which each hole pierced by the etching presents a blurred periphery. The magnesium content should therefore be limited within a range of from 0.0003 to 0.0020 wt.%.

Calcium is different from magnesium in the temperature region for forming the precipitates of sulfur and oxygen. It is therefore possible to cause sulfur and oxygen to precipitate in the form of stable and non-detrimental substances and thus to improve hot workability of the Fe-Ni alloy by adding both calcium and magnesium. Even when the Fe-Ni alloy contains both calcium and magnesium in amounts within the scope of the present invention, hot workability of the Fe-Ni alloy cannot sometimes be improved sufficiently. This is explained below with reference to FIG. 1.

FIG. 1 is a graph illustrating, when changing the contents of calcium and magnesium, respectively, in a slab and a sheet each comprising an Fe-Ni alloy having a chemical composition within the scope of the present invention except for the contents of calcium and magnesium, the effect of each of the contents of calcium and magnesium, on the amount of slab scarfing, etching pierceability of the Fe-Ni alloy sheet, sticking of the flat masks during the annealing thereof, and the production of gases from the surface of the shadow mask during the operation of the color cathode-ray tube.

As is clear from FIG. 1, even with a calcium (Ca) content of at least 0.0002 wt.% and a magnesium (Mg) content of at least 0.0003 wt.%, when the total amount of $Ca+\frac{1}{2}Mg$ is under 0.0005 wt.%, hot workability of the Fe-Ni alloy is deteriorated, thus resulting in an amount of slab scarfing of over 5 mm per surface, and fine inner cracks are produced in the Fe-Ni alloy sheet, thus resulting in the production of gases from the surface of the shadow mask during the operation the color cathode-ray tube. On the other hand, even with a calcium content and the magnesium content both of under 0.0020 wt.%, when the total amount of $Ca+\frac{1}{2}Mg$ is over 0.0025 wt.%, a firm oxide film mainly comprising calcium and magnesium is formed on the surface of the Fe-Ni alloy sheet, thus causing the piercing defect in the Fe-Ni alloy sheet, in which each hole pierced by the etching represents a blurred periphery, and sticking of the flat masks during the annealing thereof. The total amount of $Ca+\frac{1}{2}Mg$ should be limited within a range of from 0.0005 to 0.0025 wt.%.

(6) Carbon

Carbon is one of impurities inevitably entrapped in the Fe-Ni alloy. The carbon content should preferably be the lowest possible. With a carbon content of over 0.0050 wt.%, carbides are produced in a large amount in the Fe-Ni alloy, thus deteriorating hot workability thereof. As a result, considerable surface flaws are produced on the slab during the slabbing rolling thereof, thus reducing the production yield, and fine inner cracks are produced in the Fe-Ni alloy sheet, thus causing the production of gases from the surface of the shadow mask during the operation of the color cathode-ray tube. Furthermore, a carbon content of over 0.0050 wt.% impairs etching pierceability of the Fe-Ni alloy sheet. The carbon content should therefore be limited to up to 0.0050 wt.%.

(7) Nitrogen

Nitrogen is one of impurities inevitably entrapped in the Fe-Ni alloy. The nitrogen content should preferably be the lowest possible. With a nitrogen content of over 0.0020 wt.%, nitrides precipitate onto the austenitic crystal grain boundary in the Fe-Ni alloy, thus deteriorating hot workability thereof. As a result, considerable surface flaws are produced on the slab during the slabbing rolling thereof, thus reducing the production yield, and fine inner cracks are produced in the Fe-Ni alloy sheet, thus causing the production of gases from the surface of the shadow mask during the operation of the color cathode-ray tube. Furthermore, a nitrogen content of over 0.0020 wt.% impairs etching pierceability of the Fe-Ni alloy sheet The nitrogen content should therefore be limited to up to 0.0020 wt.%.

(8) Sulfur

Sulfur is one of impurities inevitably entrapped in the Fe-Ni alloy. The sulfur content should preferably be the lowest possible. With a sulfur content of over 0.0020 wt.%, sulfides precipitate onto the austenitic crystal grain boundary in the Fe-Ni alloy to embrittle the crystal grain boundary, thus deteriorating hot workability of the Fe-Ni alloy. As a result, considerable surface flaws are produced on the slab during the slabbing rolling thereof, thus reducing the production yield, and fine inner cracks are produced in the Fe-Ni alloy sheet, thus causing the production of gases from the surface of the shadow mask during the operation of the color cathode-ray tube. Furthermore, a sulfur content of over 0.0020 wt.% hinders the formation of an oxide film mainly comprising silicon, which is effective for the prevention of sticking of the flat masks during the annealing thereof. In addition, a sulfur content of over 0.0020 wt.% impairs etching pierceability of the Fe-Ni alloy sheet. The sulfur content should therefore be limited to up to 0.0020 wt.%. For the purpose of effectively preventing sticking of the flat masks from occurring during the annealing thereof, the sulfur content should preferably be limited to up to 0.0005 wt.%.

(9) Oxygen

Oxygen is one of impurities inevitably entrapped in the Fe-Ni alloy. The oxygen content should preferably be the lowest possible. With an oxygen content of over 0.0040 wt.%, low-melting-point oxides precipitate onto the austenitic crystal grain boundary in the Fe-Ni alloy, thus deteriorating hot workability thereof. As a result, considerable surface flaws are produced on the slab during the slabbing rolling thereof, thus reducing the production yield, and fine inner cracks are produced in the Fe-Ni alloy sheet, thus causing the production of gases from the surface of the shadow mask during the operation of the color cathode-ray tube. Furthermore, an oxygen content of over 0.0040 wt.% impairs etching pierceability of the Fe-Ni alloy sheet. The oxygen content should therefore be limited to up to 0.0040 wt.%.

(10) Phosphorus

Phosphorus is one of impurities inevitably entrapped in the Fe-Ni alloy. The phosphorus content should preferably be the lowest possible. With a phosphorus content of over 0.0040 wt.%, phosphides precipitate onto the austenitic crystal grain boundary in the Fe-Ni alloy, to embrittle the crystal grain boundary, thus deteriorating hot workability of the Fe-Ni alloy. As a result, considerable surface flaws are produced on the slab during the slabbing rolling thereof, thus reducing the production yield, and fine inner cracks are produced in the Fe-Ni alloy sheet, thus causing the production of gases from the surface of the shadow mask during the operation of the color cathode-ray tube. Furthermore, a phosphorus content of over 0.0040 wt.% causes the segregation of phosphorus on the surface of the Fe-Ni alloy sheet, this hindering the formation of an oxide film mainly comprising silicon, which is effective for the prevention of sticking of the flat masks during the annealing thereof. In addition, a phosphorus content of over 0.0040 wt.% impairs etching pierceability of the Fe-Ni alloy sheet. The phosphorus content should therefore be limited to up to 0.0040 wt.%. For the purpose of effectively preventing sticking of the flat masks from occurring during the annealing thereof, the phosphorus content should preferably be limited to up to 0.0010 wt.%.

Even when the contents of carbon (C), nitrogen (N), sulfur(S), oxygen(O) and phosphorus(P) as the incidental impurities are within the respective ranges of the present invention, a total amount of $1/10\ C+1/10\ N+S+1/5\ O+\frac{1}{2}\ P$ of over 0.0045 wt.% leads to serious embrittlement of the austenitic crystal grain boundary through the decrease in strength of the austenitic grain boundary by nitrogen, sulfur, oxygen and phosphorus and strengthening of the austenitic crystal grain by carbon. As a result, fine cracks are produced at the triple point on the austenitic grain boundary during the slabbing rolling of the slab. These fine cracks remain unwelded in the Fe-Ni alloy sheet as the fine inner cracks, even by applying the hot rolling after the slabbing rolling. When the etching piercing is applied to the Fe-Ni alloy sheet having such fine inner cracks, cracks are exposed on the surface of each hole pierced by the etching, into which the etching solution penetrates. As a result, when the shadow mask is heated by the radiation of an electron beam during operation of the color cathode-ray tube, the etching solution having penetrated into the cracks is vaporized and is released as gases. The total content of $1/10\ C+1/10\ N+S+1/5\ O+\frac{1}{2}\ P$ should therefore be limited to up to 0.0045 wt.%.

(11) Non-metallic inclusions

Non-metallic inclusions are one of impurities inevitably entrapped in the Fe-Ni alloy. The non-metallic inclusions mainly comprise calcium oxide (CaO), aluminum oxide ($Al_2O_3$) and magnesium oxide (MgO) and exert an important effect on etching pierceability of the Fe-Ni alloy sheet. When the content of the non-metallic inclusions in the Fe-Ni alloy sheet is over 0.0040 wt.% as converted into oxygen, etching pierceability of the Fe-Ni alloy sheet is impaired, and this may cause a piercing defect. The content of the non-metallic inclusions should therefore be limited to up to 0.0040 wt.% as converted into oxygen.

Figure 3:
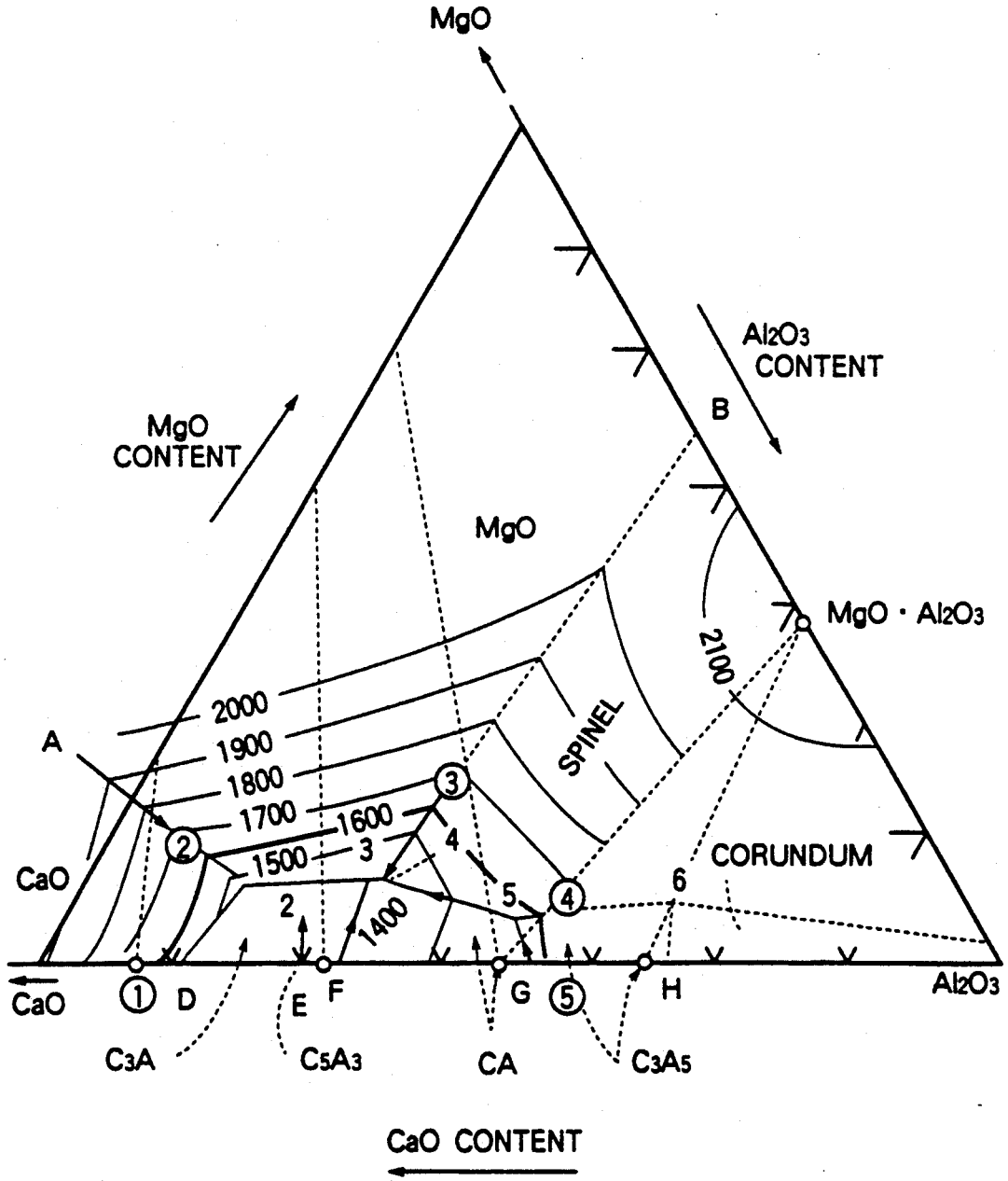
FIG. 3 is part of the $CaO$-$Al_2O_3$-$MgO$ ternary phase diagram illustrating the region of the chemical composition of non-metallic inclusions present in the Fe-Ni alloy sheet of the present invention.

When the non-metallic inclusions in the Fe-Ni alloy sheet comprise a composition in a region of a melting point of at least 1,600° C. as defined, in the $CaO-Al_2O_3-MgO$ ternary phase diagram shown in FIG. 3, by the liquidus curve (i.e., the thick solid curve in FIG. 3) of 1,600° C., which is the region other than that surrounded by the line connecting sequentially the points 1, 2, 3, 4 and 5 in FIG. 3, the non-metallic inclusions would have a particle size of up to 6 μm, and the Fe-Ni alloy sheet shows an excellent etching pierceability, particularly roughness of the surface of each hole pierced by the etching is reduced and contamination of the etching solution is alleviated, thus improving the etching operation efficiency. The non-metallic inclusion should therefore comprise the composition in the region other than that surrounded by the line connecting sequentially the points 1, 2, 3, 4, and 5 in the $CaO-Al_2O_3-MgO$ ternary phase diagram shown in FIG. 3.

In order to control the non-metallic inclusions in the Fe-Ni alloy within the above-mentioned composition, it is necessary to use a ladle made of an MgO-CaO refractory containing CaO in an amount of from 20 to 40 wt.% in the ladle refining of the molten Fe-Ni alloy after tapping, and cause the molten Fe-Ni alloy to react in the above-mentioned ladle with a $CaO-Al_2O_3-MgO$ molten slag comprising at least 57 wt.% CaO and $Al_2O_3$, where the ratio of $CaO/(CaO+Al_2O_3)$ being at least 0.45, up to 25 wt.% MgO, up to 15 wt.% $SiO_2$ and up to 3 wt.% oxides of metals having an oxygen affinity lower than that of silicon. When the molten Fe-Ni alloy is deoxidized in the manner as described above, the amount of dissolved oxygen remaining in the molten Fe-Ni alloy is reduced, and the oxides produced in the molten Fe-Ni alloy are absorbed into the slag. This results in a total amount of the non-metallic inclusions present in the Fe-Ni alloy sheet of up to 0.0040 wt.% as converted into oxygen. In other words, according as the amount of dissolved oxygen remaining in the molten Fe-Ni alloy decreases, not only the total amount of the non-metallic inclusions precipitating during the solidification of the molten Fe-Ni alloy decreases, but also the growth of the particle size of the non-metallic inclusions is inhibited because of the absence of the low-melting-point suspensions forming precipitation nuclei.

By controlling the non-metallic inclusions in the Fe-Ni alloy within the above-mentioned composition, the non-metallic inclusions in the Fe-Ni alloy sheet for a shadow mask comprise mainly spherical non-metallic inclusions having a particle size of up to 3 μm, almost free from linear non-metallic inclusions having malleability in the rolling direction. This inhibits the formation of pits on the surface of each hole pierced by the etching, which are caused by the non-metallic inclusions, and almost eliminates the problem of contamination of the etching solution.

For calcium (Ca) and magnesium (Mg) as the constituent elements and sulfur (S) and oxygen (O) as the incidental impurities in the Fe-Ni alloy sheet for a shadow mask, furthermore, the following requirements must be met; The lower limit value of the total amount of $Ca+\frac{1}{2}Mg$ varies with the change in the total amount of $S+1/5\,O$ within the above-mentioned range of the total amount of $Ca+\frac{1}{2}Mg$. This is explained further in detail below with reference to FIG. 2.

Figure 2:
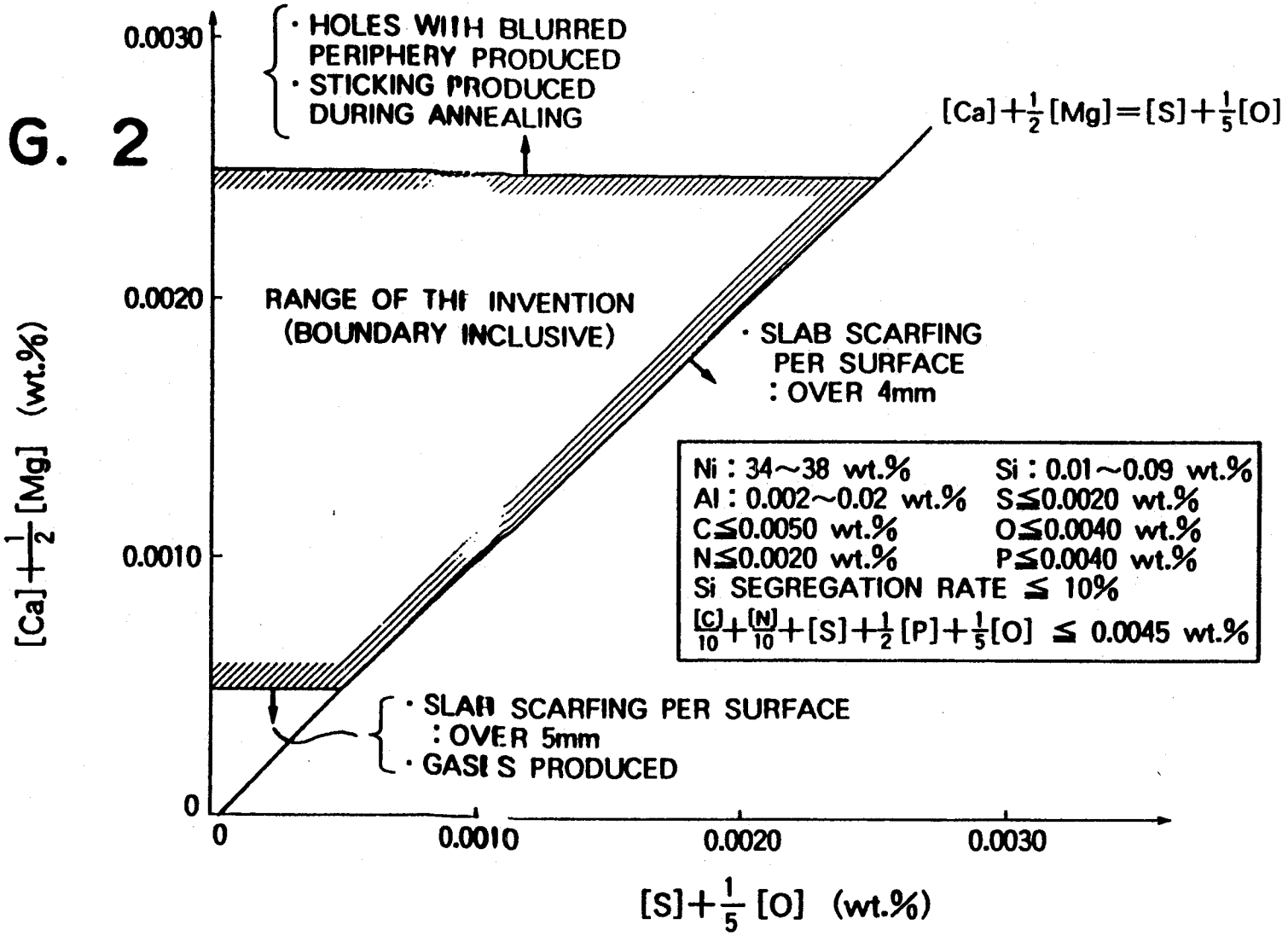
FIG. 2 is a graph illustrating, when changing values of Ca+½ Mg and S+½ O, respectively, in a slab and a sheet each comprising an Fe-Ni alloy having a chemical composition within the scope of the present invention except for the values of Ca+½ Mg and S+1/5 O, the effect of each of the values of Ca+½ Mg and S+1/5 O, on the amount of slab scarfing, etching pierceability of the Fe-Ni alloy sheet, sticking of the flat masks during the annealing thereof, and the production of gases from the surface of the shadow mask during the operation of the color cathode-ray tube.

FIG. 2 is a graph illustrating, when changing values of $Ca+\frac{1}{2}Mg$ and $S+\frac{1}{2}O$, respectively, in a slab and a sheet each comprising an Fe-Ni alloy having a chemical composition within the scope of the present invention except for the values of $Ca+\frac{1}{2}Mg$ and $S+1/5\,O$, the effect of each of the values of $Ca+\frac{1}{2}Mg$ and $S+1/5\,O$, on the amount of slab scarfing, etching pierceability of the Fe-Ni alloy sheet, sticking of the flat masks during the annealing thereof, and the production of gases from the surface of the shadow mask during the operation of the color cathode-ray tube.

As is clear from FIG. 2, even when the contents of calcium, magnesium, sulfur and oxygen are within the respective ranges of the present invention and the total amount of $Ca+\frac{1}{2}Mg$ is within the scope of the present invention, sulfur and oxygen cannot be precipitated sufficiently in the form of stable and non-detrimental substances, if the total amount of $Ca+\frac{1}{2}Mg$ is smaller than the total amount of $S+1/5\,O$ (i.e., $Ca+\frac{1}{2}Mg<S+1/5\,O$). As a result, the amount of slab scarfing increases to over 4 mm, and hot workability of the Fe-Ni alloy cannot be remarkably improved. When the contents of calcium, magnesium, sulfur and oxygen are within the respective ranges of the present invention, the total amount of $Ca+\frac{1}{2}Mg$ is within the scope of the present invention, and the total amount of $Ca+\frac{1}{2}Mg$ is equal to or larger than the total amount of $S+\frac{1}{2}O$ (i.e., $Ca+\frac{1}{2}Mg\geqq S+1/5\,O$), sulfur and oxygen can be precipitated sufficiently in the form of the stable and non-detrimental substances, and as a result, hot workability of the Fe-Ni alloy can be remarkable improved. The contents of calcium, magnesium, sulfur and oxygen should therefore satisfy the following formula:

$$Ca+\tfrac{1}{2}Mg\geqq S+1/5\,O.$$

The manner of reducing the silicon segregation rate in the surface portion of the Fe-Ni alloy sheet to up to 10% is described below with reference to FIGS. 4 and 5.

Figure 4:
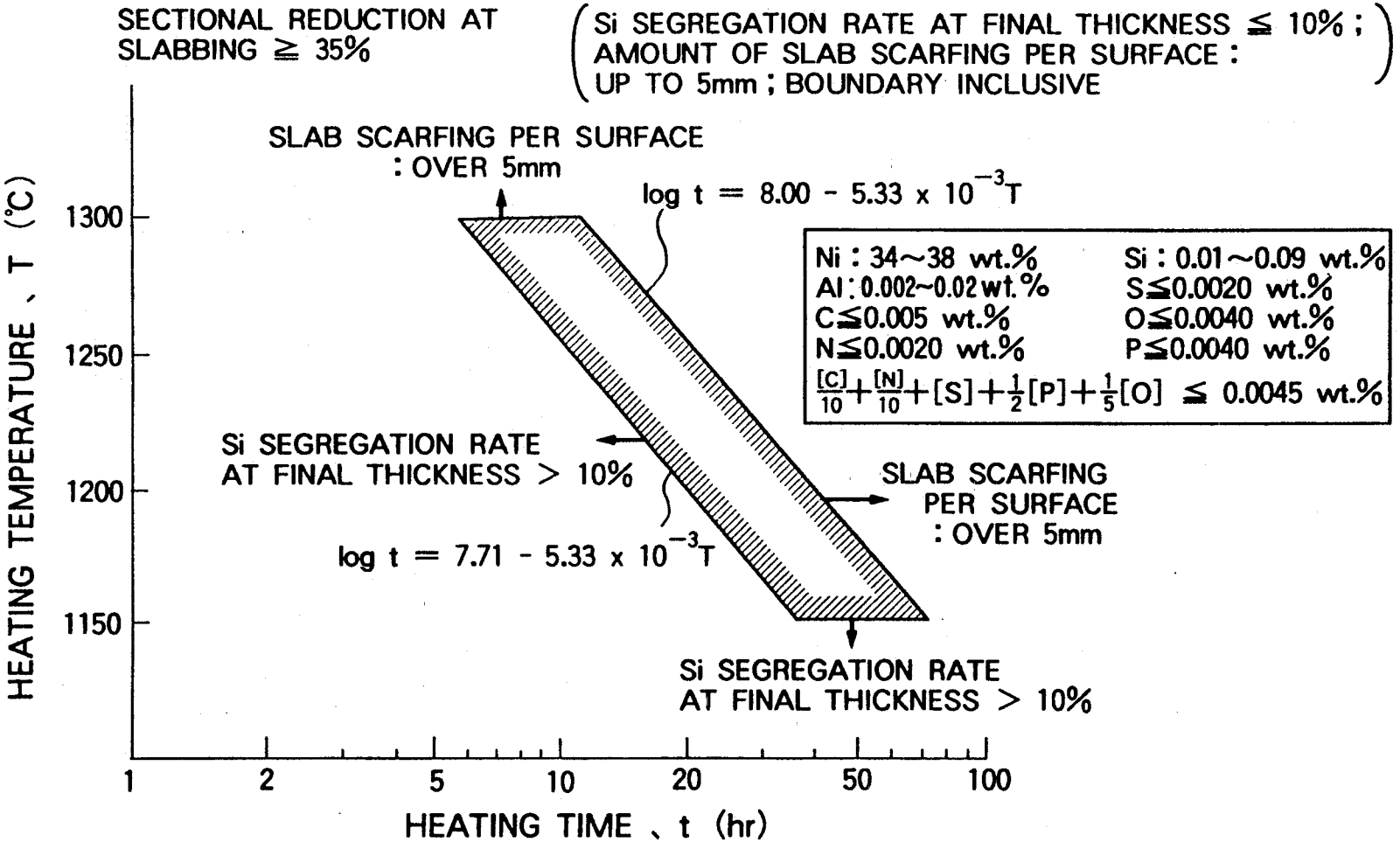
FIG. 4 is a graph illustrating, when heating an ingot or a continuously cast slab, each of which comprises an Fe-Ni alloy having a chemical composition within the scope of the present invention, then slabbing rolling same at a sectional reduction rate of at least 35%, the effect of each of the heating temperature (T)(° C.) and the heating time (t)(hr), on the silicon (Si) segregation rate in the surface portion of the Fe-Ni alloy sheet at the final thickness, and the amount of slab scarfing.

FIG. 4 is a graph illustrating, when heating an ingot or a continuously cast slab, each of which comprises an Fe-Ni alloy having a chemical composition within the scope of the present invention, then slabbing-rolling same at a sectional reduction rate of at least 35%, the effect of each of the heating temperature (T)(° C.) and the heating time (t)(hr), on the silicon (Si) segregation rate in the surface portion of the Fe-Ni alloy sheet at the final thickness, and the amount of slab scarfing.

As is clear from FIG. 4, when the above-mentioned ingot or continuously cast slab is heated at a heating temperature (T)(° C.) for a heating time (t)(hr) which satisfy the following three formulae:

$$1{,}150^\circ\,C.\leqq T\leqq 1{,}300^\circ\,C.,$$

$$\log t\geqq 7.71-5.33\times10^{-3}T,\text{ and}$$

$$\log t\leqq 8.00-5.33\times10^{-3}T,$$

then slabbing-rolled at a sectional reduction rate of at least 35%, and then slowly cooled, the amount of slab scarfing per surface is reduced to up to 5 mm, and the Si segregation rate in the surface portion of the prepared Fe-Ni alloy sheet is reduced to up to 10%. When the heating temperature (T) is under 1,150° C., or the heating time (t) is: $\log t<7.71-5.33\times10^{-3}T$, on the other hand, the Si segregation rate is increased to over 10%. When the heating temperature (T) is over 1,300° C., or the heating time (t) is: $\log t>8.00-5.33\times10^{-3}T$, the amount of slab scarfing per surface is increased to over 5 mm, resulting in a lower production yield. The heating temperature (T)(° C.) and the heating time (t)(hr), when slabbing-rolling the ingot or the continuously cast slab at a sectional reduction rate of at least 35%, should therefore be limited within ranges of:

$$1{,}150^\circ\,C.\leqq T\leqq 1{,}300^\circ\,C.,\text{ and}$$

$$7.71-5.33\times10^{-3}T\leqq\log t\leqq 8.00-5.33\times10^{-3}T.$$

Figure 5:
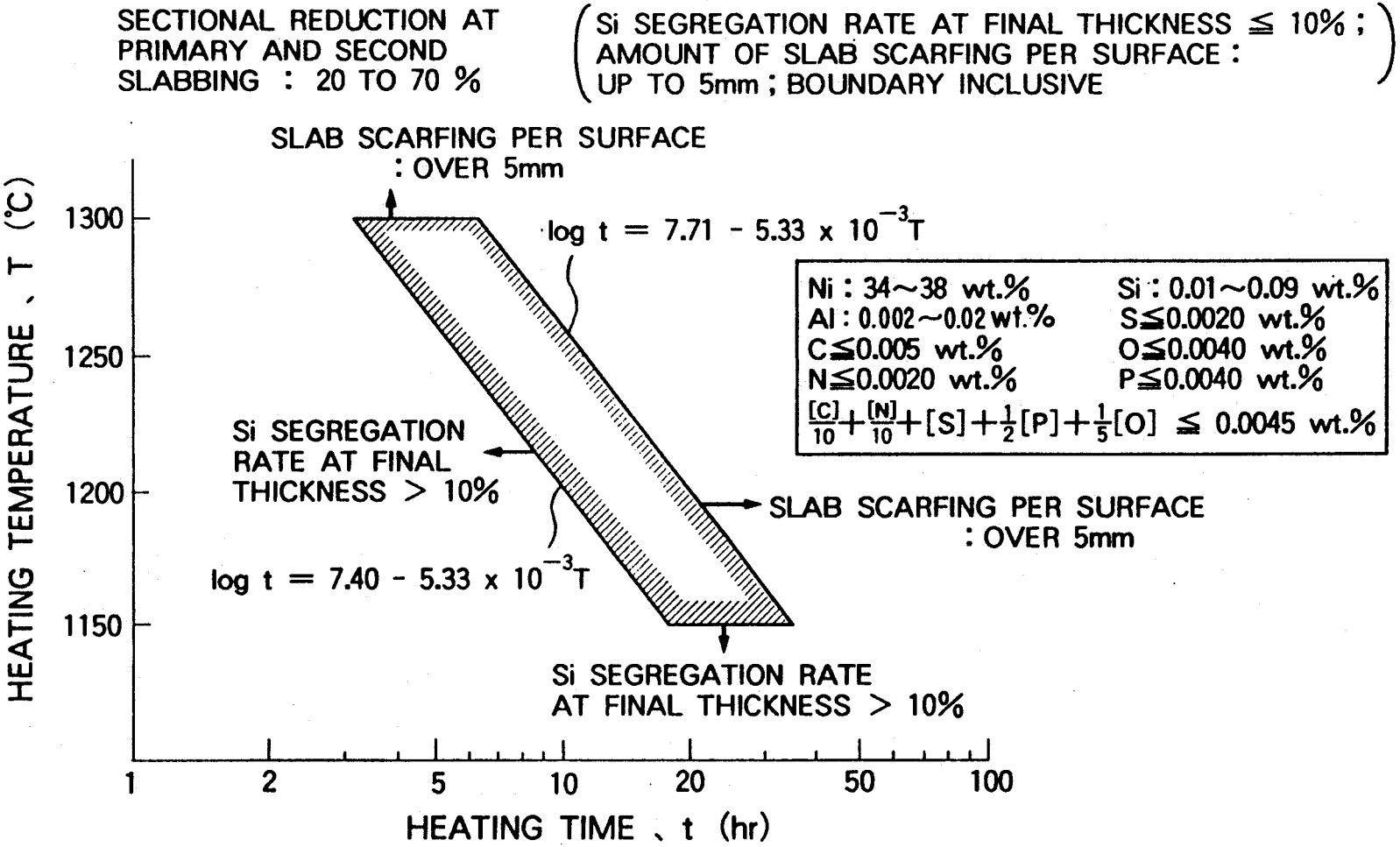
FIG. 5 is a graph illustrating, when heating an ingot or a continuously cast slab, each of which comprises an Fe-Ni alloy having a chemical composition within the scope of the present invention, then subjecting same to a primary slabbing rolling at a sectional reduction rate of from 20 to 70%, then heating same again, and then subjecting same to a secondary slabbing rolling at a sectional reduction rate of from 20 to 70%, the effect of each of the heating temperature (T)(° C.) and the heating time (t)(hr), on the silicon (Si) segregation rate in the surface portion of the Fe-Ni alloy sheet at the final thickness, and the amount of slab scarfing.

FIG. 5 is a graph illustrating, when heating an ingot or a continuously cast slab, each of which comprises an Fe-Ni alloy having a chemical composition within the scope of the present invention, then subjecting same to a primary slabbing rolling at a sectional reduction rate of from 20 to 70%, then heating same again, and then subjecting same to a secondary slabbing rolling at a sectional reduction rate of from 20 to 70%, the effect of each of the heating temperature (T)(° C.) and the heating time (t)(hr), on the silicon (Si) segregation rate in the surface portion of the Fe-Ni alloy sheet at the final thickness, and the amount of slab scarfing.

As is clear from FIG. 5, when the above-mentioned ingot or continuously cast slab is heated at a heating temperature (T)(° C.) for a heating time (t)(hr), which satisfy the following three formulae:

$$1{,}150^\circ\,C.\leqq T\leqq 1{,}300^\circ\,C.,$$

$\log t \geqq 7.40 - 5.33 \times 10^{-3}T$, and $\log t \leqq 7.71 - 5.33 \times 10^{-3}T$, then subjected to a primary slabbing rolling at a sectional reduction rate within a range of from 20 to 70%, then heated again at a heating temperature for a heating time, which satisfy the three formulae presented above, then subjected to a secondary slabbing rolling at a sectional reduction rate within a range of from 20 to 70%, and then slowly cooled, the amount of slab scarfing per surface is reduced to up to 5 mm, and the Si segregation rate in the surface portion of the prepared Fe-Ni alloy sheet is reduced to up to 10%. When either heating temperature (T) is under 1,150° C., or either heating time (t) is: $\log t < 7.40 - 5.33 \times 10^{-3}T$, on the other hand, the Si segregation rate is increased to over 10%. When either heating temperature (T) is over 1,300° C., or either heating time (t) is: $\log t < 7.71 - 5.33 \times 10^{-3}T$, the amount of slab scarfing per surface is increased to over 5 mm, resulting in a lower production yield. The heating temperature (T)(° C.) and the heating time (t)(hr), when subjecting the ingot or the continuously cast slab to the primary slabbing rolling and the secondary slabbing rolling, respectively, at a sectional reduction rate within a range of from 20 to 70%, should therefore be limited within ranges of:

$1{,}150° \leqq T \leqq 1{,}300°$ C., and $7.40 - 5.33 \times 10^{-3}T \leqq \log t \leqq 7.71 - 5.33 \times 10^{-3}T$.

Even when the ingot or the continuously cast slab, each of which comprises the Fe-Ni alloy having a chemical composition within the scope of the present invention is heated at a temperature for a time within the above-mentioned ranges of the present invention, and then subjected to the slabbing rolling at a sectional reduction rate within the range of the present invention, if a hydrogen sulfide ($H_2S$) concentration in the heating atmosphere in the heating furnace is over 100 ppm, embrittlement of the crystal grain boundary is caused on the surface portion of the ingot or the continuously cast slab during the heating thereof under the effect of sulfur, and many flaws are produced on the slab during the slabbing rolling thereof, thus resulting in an amount of slab scarfing per surface of over 5 mm. The $H_2S$ concentration in the heating atmosphere in the heating furnace should therefore be limited to up to 100 ppm.

In order to further reduce the silicon (Si) segregation rate, it is necessary to apply the slow cooling after the slabbing rolling.

In addition to the slow cooling, prevention of the Si segregation during the manufacture of an ingot, or the rapid solidification of the ingot through, for example, casting into a thin ingot may be adopted in order to further reduce the Si segregation rate. More specifically, the Si segregation rate may be reduced by adopting electromagnetic stirring during the casting, unidirectional solidification by the slight rolling reduction, shortening of the solidification time by using a flat mold, and combination of the hot working, the warm working and the cold working under the appropriate working and heat treatment conditions in the individual manufacturing steps.

Now, the present invention is described further in detail by means of examples.

EXAMPLE 1

Ingots Nos. 1 to 19 each having a chemical composition as shown in Table 1(a) and 1(b) and having a weight of 7 tons were prepared by the ladle refining.

TABLE 1(a)

| Ingot No. | Ni | Si | Sol. Al | Ca | Mg | C | N | S | O | P |
|---|---|---|---|---|---|---|---|---|---|---|
| | (wt. %) | | | | | | | | | |
| 1 | 35.5 | 0.02 | 0.008 | 0.0006 | 0.0010 | 0.0015 | 0.0012 | 0.0005 | 0.0010 | 0.001 |
| 2 | 35.7 | 0.05 | 0.007 | 0.0010 | 0.0009 | 0.0019 | 0.0014 | 0.0007 | 0.0014 | 0.002 |
| 3 | 36.0 | 0.907 | 0.007 | 0.0007 | 0.0014 | 0.0060 | 0.0015 | 0.0010 | 0.0020 | 0.001 |
| 4 | 36.1 | 0.05 | 0.006 | 0.0010 | 0.0012 | 0.0035 | 0.0025 | 0.0012 | 0.0017 | 0.002 |
| 5 | 35.9 | 0.03 | 0.005 | 0.0016 | 0.0018 | 0.0020 | 0.0010 | 0.0022 | 0.0013 | 0.002 |
| 6 | 35.9 | 0.02 | 0.001 | 0.0017 | 0.0016 | 0.0028 | 0.0012 | 0.0014 | 0.0050 | 0.003 |
| 7 | 35.7 | 0.09 | 0.010 | 0.0010 | 0.0010 | 0.0028 | 0.0014 | 0.0008 | 0.0018 | 0.005 |
| 8 | 35.9 | 0.13 | 0.008 | 0.0016 | 0.0010 | 0.0024 | 0.0015 | 0.0012 | 0.0028 | 0.002 |
| 9 | 35.8 | <0.01 | 0.006 | 0.0018 | 0.0012 | 0.0020 | 0.0020 | 0.0015 | 0.0021 | 0.002 |
| 10 | 35.6 | 0.07 | 0.012 | 0.0024 | 0.0002 | 0.0027 | 0.0011 | 0.0013 | 0.0015 | 0.003 |
| 11 | 35.7 | 0.06 | 0.011 | 0.0001 | 0.0018 | 0.0022 | 0.0015 | 0.0004 | 0.0026 | 0.004 |
| 12 | 35.6 | 0.06 | 0.014 | 0.0006 | 0.0025 | 0.0026 | 0.0012 | 0.0015 | 0.0018 | 0.003 |
| 13 | 35.9 | 0.05 | 0.009 | 0.0015 | 0.0001 | 0.0023 | 0.0013 | 0.0010 | 0.0014 | 0.003 |
| 14 | 35.7 | 0.04 | 0.007 | 0.0020 | 0.0019 | 0.0025 | 0.0013 | 0.0012 | 0.0014 | 0.003 |
| 15 | 35.8 | 0.07 | 0.007 | 0.0002 | 0.0004 | 0.0025 | 0.0012 | 0.0001 | 0.0008 | 0.003 |
| 16 | 35.6 | 0.04 | 0.006 | 0.0016 | 0.0016 | 0.0027 | 0.0015 | 0.0016 | 0.0039 | 0.004 |
| 17 | 36.3 | 0.02 | 0.005 | 0.0007 | 0.0006 | 0.0016 | 0.0012 | 0.0013 | 0.0016 | 0.004 |
| 18 | 35.9 | 0.03 | 0.025 | 0.0014 | 0.0012 | 0.0023 | 0.0016 | 0.0014 | 0.0026 | 0.003 |
| 19 | 35.5 | 0.02 | 0.008 | 0.0006 | 0.0010 | 0.0015 | 0.0012 | 0.0005 | 0.0010 | 0.001 |

TABLE 1(b)

| Ingot No. | Ca + ½Mg | 1/10C + 1/10N + S + 1/5O + ½P | Ratio of (Ca + ½Mg)/(S + 1/5O) | Other constituent element | Balance |
|---|---|---|---|---|---|
| | (wt. %) | | | | |
| 1 | 0.0011 | 0.0015 | 1.6 | | Fe and incidental impurities |
| 2 | 0.0015 | 0.0023 | 1.5 | | |
| 3 | 0.0014 | 0.0027 | 1.0 | | |
| 4 | 0.0016 | 0.0031 | 1.0 | | |
| 5 | 0.0025 | 0.0038 | 1.0 | | |
| 6 | 0.0025 | 0.0043 | 1.0 | | |

TABLE 1(b)-continued

| Ingot No. | Ca + ½Mg | 1/10C + 1/10N + S + 1/5O + ½P | Ratio of (Ca + ½Mg)/(S + 1/5O) | Other constituent element | Balance |
|---|---|---|---|---|---|
| | (wt. %) | | | | |
| 7 | 0.0015 | 0.0041 | 1.3 | | |
| 8 | 0.0021 | 0.0032 | 1.2 | | |
| 9 | 0.0024 | 0.0033 | 1.3 | | |
| 10 | 0.0025 | 0.0035 | 1.6 | | |
| 11 | 0.0010 | 0.0033 | 1.1 | | |
| 12 | 0.0019 | 0.0037 | 1.0 | | |
| 13 | 0.0016 | 0.0031 | 1.3 | Mn: 0.30 | |
| 14 | 0.0030 | 0.0034 | 2.4 | | |
| 15 | 0.0004 | 0.0031 | 1.5 | | |
| 16 | 0.0024 | 0.0050 | 1.0 | | |
| 17 | 0.0010 | 0.0039 | 0.6 | | |
| 18 | 0.0020 | 0.0038 | 1.0 | | |
| 19 | 0.0011 | 0.0015 | 1.6 | | |

The ladle used for the ladle refining of the ingots Nos. 1 to 5 and 7 to 19 was made of an MgO-CaO refractory containing CaO in an amount of from 20 to 40 wt.%, and the molten slag used was a $CaO-Al_2O_3-MgO$ slag, having a ratio of $(CaO)/(CaO)+\{(Al_2O_3)\}$ of at least 0.45 and containing up to 25 wt.% MgO, up to 15 wt.% $SiO_2$, and up to 3 wt.% oxide of a metal having an oxygen affinity lower than that of silicon.

The ladle used for the ladle refining of the ingot No. 6 was made of an MgO-CaO refractory containing CaO in an amount of from 20 to 40 wt.%, and the molten slag used was a $CaO-SiO_2-Al_2O_3$ slag, having a ratio of $CaO/SiO_2$ of from 0.65 to 0.80 and containing up to 3 wt.% $Al_2O_3$ and up to 15 wt.% MgO.

Each of the thus prepared ingots Nos. 1 to 18 was scarfed, heated in a heating atmosphere having a hydrogen sulfide ($H_2S$) concentration of 50 ppm to a temperature of 1,200° C. for 20 hours, then subjected to a primary slabbing rolling at a sectional reduction rate of 60%, then heated again in a heating atmosphere having an $H_2S$ concentration of 50 ppm to a temperature of 1,200° C. for 20 hours, then subjected to a secondary slabbing rolling at a sectional reduction rate of 45%, and then slowly cooled to prepare slabs Nos. 1 to 18. On the other hand, the ingot No. 19 prepared as described above was scarfed, heated in a heating atmosphere having an $H_2S$ concentration of 50 ppm to a temperature of 1,200° C. for 17 hours, then slabbing-rolled at a sectional reduction rate of 78%, and then slowly cooled to prepare a slab No. 19.

For each of the above-mentioned slabs Nos. 1 to 19, production of surface flaws was investigated by observing the entire surface of each slab. The amount of surface scarfing was determined by measuring the amount of decrease in the thickness and the width of the slab after the fusion-scraping by means of the cold scarfing. The results are shown in Table 2.

Then, each of the thus prepared slabs Nos. 1 to 19 was scarfed, applied with an oxidation preventing agent, heated to a temperature of 1,100° C., and subjected to a hot rolling to prepare each of hot-rolled coils Nos. 1 to 19. The hot rolling conditions included a total reduction rate of 82% at a temperature of at least 1,000° C., a total reduction rate of 98% at a temperature of at least 850° C., and a coiling temperature of the hot-rolled coil of from 550° to 750° C.

Each of the thus prepared hot-rolled coils Nos. 1 to 19 was descaled, subjected to repeated cycles each comprising a cold rolling and an annealing, and then subjected to a stress-relieving annealing to prepare each of Fe-Ni alloy sheets for a shadow mask having a thickness of 0.25 mm (hereinafter referred to as the "samples") Nos. 1 to 19.

For each of the thus prepared samples Nos. 1 to 19, fine inner cracks were investigated by the UST (abbreviation of Ultra Sonic Test). The results are shown in Table 2.

Then, for each of the samples Nos. 1 to 19, the silicon (Si) segregation rate in the surface portion of each sample, etching pierceability, sticking of the flat masks during the annealing thereof, and the production of gases from the surface of the shadow mask during the operation of the color cathode-ray tube were investigated.

The Si segregation rate in the surface portion of each sample was investigated by means of a mapping analyzer based on the EPMA (abbreviation of Electron Probe MicroAnalyzer). Etching pierceability of each sample was evaluated by piercing the holes in each sample by etching to check piercing defects such as irregularities in the diameter and the shape of the holes and a blurred periphery of each hole, and by observing the hole surface by means of a scanning-type electron microscope to check the presence of pits on the hole surface. Contamination of the etching solution was evaluated on the basis of the amount of residues remaining in the etching solution after the etching piercing. Sticking of the flat masks during the annealing thereof was evaluated by annealing 30 flat masks placed one on the top of the other at a temperature of 950° C. to check the occurrence of sticking of the flat masks. The production of gases from the surface of the shadow mask during the operation of the color cathode-ray tube was evaluated by annealing the flat mask at a temperature of 950° C., then holding the annealed flat mask at a temperature of 850° C. for 5 minutes under a reduced pressure, and measuring deterioration of the degree of vacuum after the lapse of 5 minutes. The results of these tests are shown in Table 2.

In addition, the chemical composition and the distribution of non-metallic inclusions in each sample were investigated. The results are shown in Table 3 and FIG. 6.

TABLE 2

| Sample No. | Si segregation rate (%) | Production of surface flaws | Amount of surface scarfing (mm) | Production of blurred periphery on pierced hole | Production of sticking during annealing | Production of gases | Production of fine inner cracks | Contamination of etching solution | Presence of pits on hole surface |
|---|---|---|---|---|---|---|---|---|---|
| 1 | 2 | ◎ | 2 | ◎ | ∘ | ∘ | None | Very slight | None |
| 2 | 5 | ◎ | 3 | ∘ | ∘ | ∘ | None | Very slight | None |
| 3 | 8 | Δ | 8 | ∘ | ∘ | X | Produced | Very slight | None |
| 4 | 6 | Δ | 7 | ∘ | ∘ | X | Produced | Very slight | None |
| 5 | 4 | X | 10 | ∘ | Δ | X | Produced | Slight | Present |
| 6 | 4 | Δ | 9 | ∘ | ∘ | X | Produced | Serious | Present |
| 7 | 9 | Δ | 9 | ∘ | Δ | X | Produced | Very slight | None |
| 8 | 9 | ∘ | 4 | X | ∘ | ∘ | None | Very slight | None |
| 9 | 4 | ∘ | 4 | ∘ | X | ∘ | None | Very slight | None |
| 10 | 10 | ∘ | 4 | Δ | Δ | ∘ | None | Very slight | None |
| 11 | 9 | Δ | 7 | ∘ | ∘ | X | Produced | Very slight | None |
| 12 | 7 | ∘ | 4 | Δ | Δ | ∘ | None | Very slight | None |
| 13 | 6 | Δ | 7 | ∘ | ∘ | X | Produced | Very slight | None |
| 14 | 6 | ∘ | 5 | Δ | Δ | ∘ | None | Very slight | None |
| 15 | 9 | Δ | 8 | ∘ | ∘ | X | Produced | Very slight | None |
| 16 | 6 | X | 12 | ∘ | ∘ | X | Produced | Very slight | None |
| 17 | 5 | ∘ | 5 | ∘ | ∘ | ∘ | None | Very slight | None |
| 18 | 5 | ∘ | 8 | Δ | ∘ | X | Produced | Very slight | None |
| 19 | 12 | ◎ | 2 | X | Δ | ∘ | None | Very slight | None |

In Table 2, the criteria for evaluation of the tests are as follows:
(1) Re: Production of surface flaws:
◎: produced very slightly;
∘: produced slightly;
Δ: produced seriously;
X: produced very seriously.
(2) Re: Production of blurred periphery on pierced pit:
◎: produced not at all,
∘: produced hardly,
Δ: produced slightly,
X: produced.
(3) Re: Production of sticking during annealing:
∘: produced not at all,
Δ: produced on part of the surface,
X: produced over the entire surface.
(4) Re: Production of gases:
∘: produced very slightly (up to $1 \times 10^{-3}$ Torr l/g),
X: produced (overy $1 \times 10^{-3}$ Torr l/g).

TABLE 3

| Sample No. | Distribution of non-metallic inclusions (number/mm²) | | | | | |
|---|---|---|---|---|---|---|
| | Spherical non-metallic inclusions (thickness in the thickness direction) (μm) | | | | Linear non-metallic inclusions (thickness in the thickness direction) (μm) | |
| | under 3 | 3–under 6 | 6–under 14 | 14– | under 3 | 3–under 5 |
| 1 | 5 | 0 | 0 | 0 | 0 | 0 |
| 2 | 7 | 1 | 0 | 0 | 0 | 0 |
| 3 | 8 | 0 | 0 | 0 | 0 | 0 |
| 4 | 10 | 1 | 0 | 0 | 0 | 0 |
| 5 | 12 | 2 | 0 | 0 | 5 | 0 |
| 6 | 20 | 3 | 0 | 0 | 10 | 0 |
| 7 | 13 | 1 | 0 | 0 | 0 | 0 |
| 8 | 16 | 0 | 0 | 0 | 0 | 0 |
| 9 | 14 | 0 | 0 | 0 | 0 | 0 |
| 10 | 15 | 1 | 0 | 0 | 0 | 0 |
| 11 | 12 | 0 | 0 | 0 | 0 | 0 |
| 12 | 13 | 2 | 0 | 0 | 0 | 0 |
| 13 | 12 | 1 | 0 | 0 | 0 | 0 |
| 14 | 12 | 2 | 0 | 0 | 0 | 0 |
| 15 | 10 | 0 | 0 | 0 | 0 | 0 |
| 16 | 12 | 0 | 0 | 0 | 0 | 0 |
| 17 | 12 | 1 | 0 | 0 | 0 | 0 |
| 18 | 13 | 0 | 0 | 0 | 0 | 0 |
| 19 | 5 | 0 | 0 | 0 | 0 | 0 |

As is clear from Table 2, the samples Nos. 1 and 2, each having a chemical composition within the scope of the present invention and an Si segregation rate within the scope of the present invention, had only very slight surface flaws, were excellent in etching pierceability, free from the occurrence of sticking during the annealing of the flat mask, and suffered from very slight production of gases.

In contrast, the sample No. 3 had a high carbon content outside the scope of the present invention, and the sample No. 4 had a high nitrogen content outside the scope of the present invention. As a result, many surface flaws were produced and much gases were produced in the samples Nos. 3 and 4.

The sample No. 5 had a high sulfur content outside the scope of the present invention, the sample No. 6 had a high oxygen content outside the scope of the present invention, and the sample No. 7 had a high phosphorus content outside the scope of the present invention. As a result, many surface flaws were produced and much gases were produced in the sample Nos. 5, 6 and 7. In addition, sticking of the flat masks was produced during the annealing thereof in the samples Nos. 5 and 7.

The sample No. 8 contained silicon in an amount of over the upper limit of the range of the present invention. As a result, the sample No. 8 showed the etching piercing defect, in which the surface of each hole pierced by the etching was seriously roughened to present a blurred periphery. The sample No. 9 contained silicon in an amount of under the lower limit of the range of the present invention. As a result, sticking of the flat masks was produced during the annealing thereof.

The sample No. 10 contained calcium in an amount of over the upper limit of the range of the present invention, the sample No. 12 contained magnesium in an amount of over the upper limit of the range of the present invention, and the sample No. 14 contained Ca+½

Mg in an amount of over the upper limit of the range of the present invention. As a result, the samples Nos. 10, 12 and 14 showed the etching piercing defect, in which the surface of each hole pierced by the etching was seriously roughened to present a blurred periphery, and furthermore, sticking of the flat masks was produced during the annealing thereof.

The sample No. 11 contained calcium in an amount of under the lower limit of the range of the present invention, the sample No. 13 contained magnesium in an amount of under the lower limit of the range of the present invention, and the sample No. 15 contained Ca+½ Mg in an amount of under the lower limit of the range of the present invention. As a result, many surface flaws were produced and much gases were produced in the samples Nos. 11, 13 and 15.

The sample No. 16 contained 1/10 C+1/10 N+S+1/5 O+½ P of over the upper limit of the range of the present invention. As a result, many surface flaws were produced and much gases were produced in the sample No. 16.

The sample No. 17 had a ratio of (Ca+½ Mg) to (S+1/5 O) of under the lower limit of the range of the present invention. As a result, the production of the surface flaws in the sample No. 17 was higher than the production of the surface flaws in the samples Nos. 1 and 2 within the scope of the present invention.

The sample No. 19 had a chemical composition within the scope of the present invention but a high Si segregation rate outside the scope of the present invention. As a result, the sample No. 19 showed the etching piercing defect, in which the surface of each hole pierced by the etching was seriously roughened to present a blurred periphery, and furthermore, sticking of the flat masks was produced during the annealing thereof.

The sample No. 18 had a high aluminum content outside the scope of the present invention. As a result, the sample No. 18 showed the etching piercing defect, in which the surface of each hole pierced by the etching was seriously roughened to present a blurred periphery, and furthermore, much gases were produced, although the production of the surface flaws was slight.

As is clear from the above description, it is possible to obtain an Fe-Ni slab free from surface flaws and an Fe-Ni alloy sheet for a shadow mask free from fine inner cracks, which is excellent in etching pierceability, free from sticking of the flat masks during the annealing thereof, and produces only little gases, by using an Fe-Ni alloy having a chemical composition within the scope of the present invention and a silicon (Si) segregation rate within the scope of the present invention.

As is clear from the above description, furthermore, there is a correlation between the production of much gases from the Fe-Ni alloy sheet and the production of fine inner cracks in the Fe-Ni alloy sheet.

The distribution of non-metallic inclusions in the samples No. 1 to 19 shown in Table 3 was investigated by the following manner: An area of 60 $mm^2$ in a cross-sectional face in the rolling direction of each sample was observed by a 800-magnification microscope to measure the thickness in the thickness direction of each sample and the length in the rolling direction of each sample of the non-metallic inclusions present in this area. In this measurement, the non-metallic inclusions were classified into spherical non-metallic inclusions and linear non-metallic inclusions in accordance with the criteria described later, and the number of non-metallic inclusions present per $mm^2$ was counted, thereby investigating the distribution of the non-metallic inclusions.

In the above-mentioned investigation, the spherical non-metallic inclusions were those having a ratio of length to thickness of the non-metallic inclusions of up to 3 (i.e., length/thickness$\leqq$3); and the linear non-metallic inclusions were those having a ratio of length to thickness of the non-metallic inclusions of over 3 (i.e., length/thickness>3).

Figure 6:
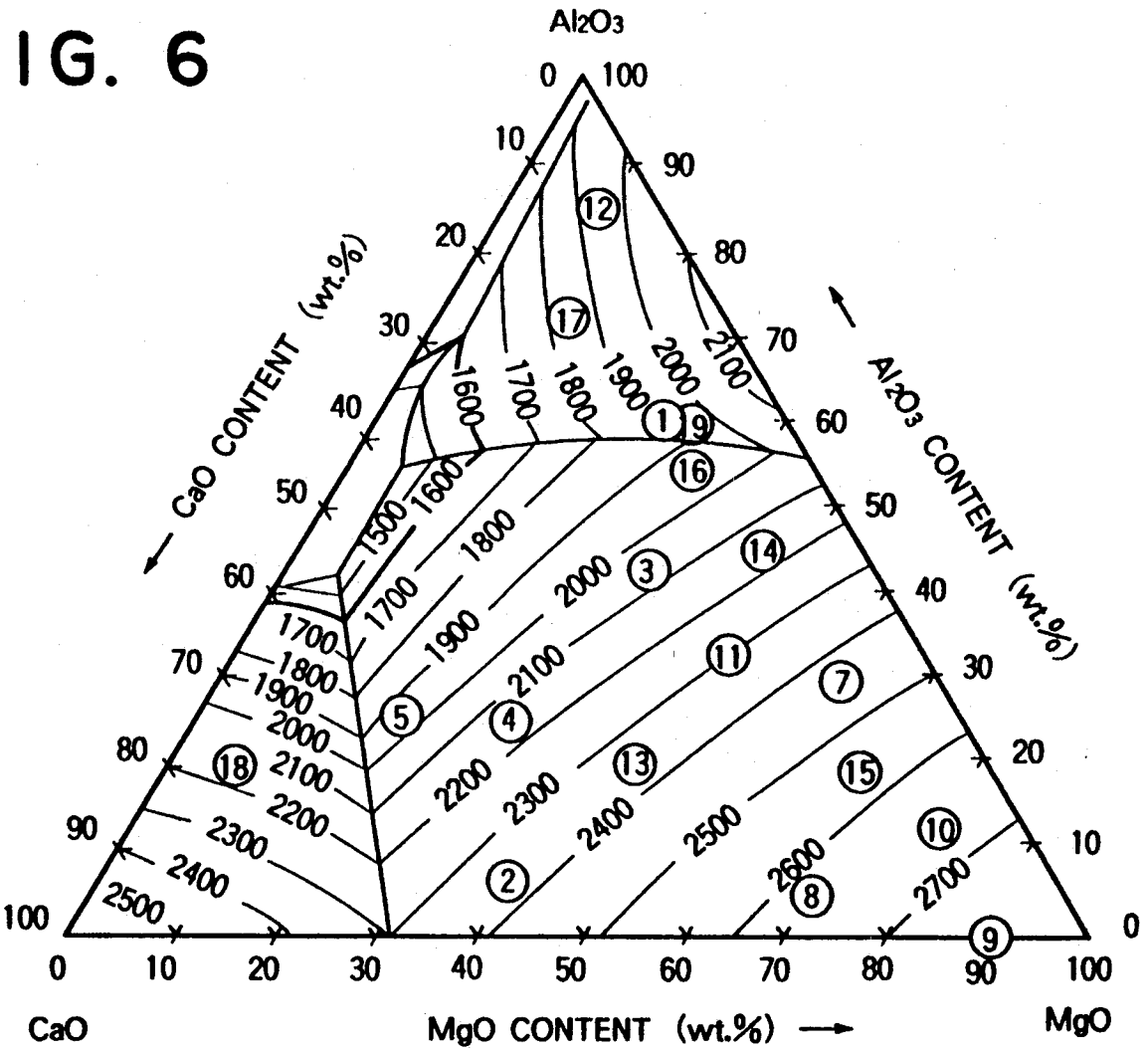
FIG. 6 is the $CaO$-$Al_2O_3$-$MgO$ ternary phase diagram illustrating the chemical composition of non-metallic inclusions contained in each of the Fe-Ni alloy sheets Nos. 1 to 5 and 7 to 19 for a shadow mask used in examples of the present invention.

As is clear from Table 3 and FIG. 6, the non-metallic inclusions in the samples Nos. 1 to 4 and 7 to 19 had a melting point of at least 1,600° C. and comprised mainly the spherical non-metallic inclusions having a thickness of under 3 μm. The formation of pits on the surface of each hole pierced by the etching, which was caused by the non-metallic inclusions, was therefore inhibited, and the problem of contamination of the etching solution caused by the entanglement of the linear non-metallic inclusions into the etching solution was hardly encountered.

The sample No. 5 had a high sulfur content outside the scope of the present invention. As a result, the non-metallic inclusions in the sample No. 5 comprised mainly the linear non-metallic inclusions as shown in Table 3. Consequently, pits were produced on the surfaces of the holes pierced by the etching, and a slight contamination of the etching solution was observed in the sample No. 5.

The non-metallic inclusions in the sample No. 6 contained 15 wt.% $Al_2O_3$, 40 wt.% MnO and 45 wt.% $SiO_2$, and comprised a composition known as spessartite in the region surrounded by the liquidus curve of 1,200° C. in the $MnO$-$SiO_2$-$Al_2O_3$ ternary phase diagram not shown. These non-metallic inclusions had a low melting point and a high deformability and were large in the total amount. As a result, the non-metallic inclusions in the sample No. 6 were deformed into an elongated linear shape in the rolling direction during the hot rolling and the cold rolling of the ingot No. 6 into the sample No. 6. Therefore, the non-metallic inclusions in the sample 6 comprised mainly the linear non-metallic inclusions as shown in Table 3, resulting in the production of pits on the surfaces of the holes pierced by the etching and a serious contamination of the etching solution.

It is possible, as is evident from the above description, to impart an excellent etching pierceability by controlling the non-metallic inclusions in the Fe-Ni alloy sheet to the composition within the scope of the present invention.

EXAMPLE 2

Each of the ingots Nos. 1 and 2 within the scope of the present invention shown in Tables 1(a) and 1(b) was scarfed, then slabbing-rolled under the conditions shown in Table 4, and then slowly cooled to prepare slabs. Each of the thus prepared slabs was scarfed, applied with an oxidation preventing agent, heated to a temperature of 1,100° C., and hot-rolled to prepare a hot-rolled coil. The hot rolling conditions included a total reduction rate of 82% at a temperature of at least 1,000° C., a total reduction rate of 98% at a temperature of at least 850° C. and a coiling temperature of the hot-rolled coil of from 550° to 750° C. Each of the thus prepared hot-rolled coils was descaled, subjected to repeated cycles each comprising a cold rolling and an annealing, and then subjected to a stress-relieving annealing to prepare each of Fe-Ni alloy sheets for a shadow mask having a thickness of 0.25 mm (hereinafter referred to as the "samples") Nos. 20 to 33.

TABLE 4

| Ingot No. | Sample No. | $H_2S$ concentration in heating atmosphere (ppm) | Primary slabbing rolling: Heating temperature (°C.) | Primary slabbing rolling: Heating time (hr) | Primary slabbing rolling: Sectional reduction rate (%) | Secondary slabbing rolling: Heating temperature (°C.) | Secondary slabbing rolling: Heating time (hr) | Secondary slabbing rolling: Sectional reduction rate (%) | Si segregation rate (%) | Remarks |
|---|---|---|---|---|---|---|---|---|---|---|
| 2 | 20 | 50 | 1,200 | 22 | 78 | — | — | — | 7 | Sample of the |
| | 21 | 55 | 1,280 | 10 | 78 | — | — | — | 5 | invention (single |
| | | | | | | | | | | slabbing rolling) |
| | 22 | 53 | 1,200 | 22 | 30 | — | — | — | 12 | Sample for |
| | 23 | 53 | 1,200 | 15 | 76 | — | — | — | 13 | comparison (single |
| | 24 | 53 | 1,200 | 45 | 77 | — | — | — | 3 | slabbing rolling) |
| 1 | 25 | 53 | 1,200 | 20 | 60 | 1,200 | 20 | 45 | 5 | Sample of the |
| | 26 | 62 | 1,290 | 6 | 61 | 1,290 | 5 | 44 | 3 | invention (double |
| | | | | | | | | | | slabbing rolling) |
| | 27 | 61 | 1,200 | 8 | 60 | 1,200 | 15 | 45 | 12 | Sample for |
| | 28 | 68 | 1,250 | 10 | 70 | 1,250 | 10 | 15 | 11 | comparison (double |
| | 29 | 68 | 1,250 | 10 | 61 | 1,250 | 20 | 44 | 7 | slabbing rolling) |
| 2 | 30 | 125 | 1,200 | 22 | 78 | — | — | — | 7 | Sample for |
| | 31 | 54 | 1,350 | 10 | 78 | — | — | — | 3 | comparison (single |
| | | | | | | | | | | slabbing rolling) |
| 1 | 32 | 50 | 1,130 | 25 | 60 | 1,130 | 25 | 44 | 15 | Sample for |
| | 33 | 68 | 1,250 | 10 | 18 | 1,250 | 10 | 73 | 11 | comparison (double |
| | | | | | | | | | | slabbing rolling) |

For each of the above-mentioned slabs, the production of surface flaws was investigated. For each of the thus prepared samples Nos. 20 to 33; fine inner cracks were investigated. Then, for each of the samples Nos. 20 to 33, the silicon (Si) segregation rate in the surface portion of each sample, etching pierceability, sticking of the flat masks during annealing thereof, and the production of gases from the surface of the shadow mask during the operation of the color cathode-ray tube were investigated. These investigations were carried out in the same manner as in the corresponding investigations described as to the Example 1. The results are shown in Table 5.

TABLE 5

| Sample No. | Production of surface flaws | Amount of surface scarfing (mm) | Production of blurred periphery on pierced hole | Production of sticking during annealing | Production of gases | Production of fine inner cracks | Remarks |
|---|---|---|---|---|---|---|---|
| 20 | ◎ | 2 | ○ | ○ | ○ | None | The criteria |
| 21 | ○ | 4 | ◎ | ○ | ○ | None | for evaluation: |
| 22 | Δ | 6 | X | Δ | ○ | None | ◎, ○, Δ, X |
| 23 | ○ | 4 | X | X | ○ | None | in each |
| 24 | Δ | 8 | ◎ | ○ | ○ | None | column are |
| 25 | ◎ | 3 | ○ | ○ | ○ | None | the same as |
| 26 | ○ | 4 | ◎ | ○ | ○ | None | in Table 2. |
| 27 | ○ | 3 | X | Δ | ○ | None | |
| 28 | Δ | 8 | X | Δ | ○ | None | |
| 29 | Δ | 10 | ○ | ○ | ○ | None | |
| 30 | X | 15 | ○ | ○ | ○ | None | |
| 31 | X | 11 | ◎ | ○ | ○ | None | |
| 32 | ◎ | 3 | X | X | ○ | None | |
| 33 | X | 11 | X | Δ | ○ | None | |

In the samples of the present invention Nos. 20, 21, 25 and 26, as is clear from Table 5, which were slabbing-rolled with a hydrogen sulfide ($H_2S$) concentration in the heating atmosphere, a heating temperature, a heating time and a sectional reduction rate within the respective ranges of the present invention and had a silicon (Si) segregation rate within the scope of the present invention, the production of surface flaws was slight, there was no occurrence of the etching piercing defect, in which the surface of each hole pierced by the etching was roughened to present a blurred periphery, with no sticking of the flat masks during the annealing thereof, and the production of gases was slight.

In contrast, the sample No. 22 was subjected to the single slabbing rolling at a sectional reduction rate of under the lower limit value of the range of the present invention. The sample No. 23 was heated to a heating temperature of under the lower limit value of the range of the present invention in the single slabbing rolling. The sample No. 27 was heated for a heating time of under the lower limit value of the range of the present invention in the primary slabbing rolling. The sample No. 28 was subjected to the secondary slabbing rolling at a sectional reduction rate of under the lower limit of the range of the present invention. The sample No. 32 was heated to a heating temperature of under the lower limit value of the range of the present invention in each of the primary slabbing rolling and the secondary slabbing rolling. The sample No. 33 was subjected to the primary slabbing rolling at a sectional reduction rate of under the lower limit value of the range of the present invention. As a result, each of the samples Nos. 22, 23, 27, 28, 32 and 33 had an Si segregation rate of over 10% in the surface portion thereof. As is clear from Table 5, therefore, each of the samples Nos. 22, 23, 27, 28, 32 and 33 showed the etching piercing defect, in which the surface of each hole pierced by the etching was roughened to present a blurred periphery, and furthermore, sticking of the flat masks was produced during the annealing thereof.

The sample No. 24 was heated for a heating time of over the upper limit value of the range of the present invention in the single slabbing rolling. The sample No. 29 was heated for a heating time of over the upper limit value of the range of the present invention in the secondary slabbing rolling. The sample No. 31 was heated to a heating temperature of over the upper limit value of the range of the present invention in the single slabbing rolling. As a result, many surface flaws were produced in the samples Nos. 24, 29 and 31.

In the sample No. 30, in which the $H_2S$ concentration in the heating atmosphere in the heating furnace was over the upper limit value of the range of the present invention, surface flaws were produced very seriously.

As is evident from the above description, it is possible to obtain an Fe-Ni alloy sheet for a shadow mask, which suffers from the production of only a few surface flaws, is free from irregularities in the diameter and the shape of the holes pierced by the etching, free from the blurred periphery of the holes, and free from the sticking of the flat masks during the annealing thereof, and produces little gases, by slabbing-rolling an ingot or a continuously cast slab each having a chemical composition within the scope of the present invention with an $H_2S$ concentration in the heating atmosphere, a heating temperature, a heating time and a sectional reduction rate within the respective ranges of the present invention.

EXAMPLE 3

The ingot No. 13 outside the scope of the present invention shown in Tables 1(a) and 1(b) was scarfed, then heated to a temperature of 1,200° C. for five hours, and then slabbing-rolled at a sectional reduction rate of 78% to prepare a slab. The thus prepared slab was scarfed, then subjected to a soaking treatment by heating to a temperature of 1,300° C. for ten hours in a heating atmosphere having an oxygen ($O_2$) concentration of 0.02 vol.%, then surface-ground, then heated to a temperature of 1,200° C. in a heating atmosphere having an $O_2$ concentration of 0.02 vol.%, and then hot-rolled at a hot-rolling finishing temperature of 950° C. to prepare a hot-rolled coil. The thus prepared hot-rolled coil was descaled, then subjected to repeated cycles each comprising a cold rolling and an annealing, and then subjected to a stress-relieving annealing at a temperature of 700° C. for ten seconds to prepare an Fe-Ni alloy sheet for a shadow mask having a thickness of 0.20 mm.

For the above-mentioned slab, the production of surface flaws was investigated. For the thus prepared Fe-Ni alloy sheet, the production of fine inner cracks, the silicon (Si) segregation rate in the surface portion of the Fe-Ni alloy sheet, etching pierceability, sticking of the flat masks during the annealing thereof, and the production of gases from the surface of the shadow mask during the operation of the color cathode-ray tube were investigated. These investigations were carried out in the same manner as in the Example 1. The results are shown in Table 6.

TABLE 6

| Si segregation rate (%) | Amount of surface scarfing (mm) | Production of blurred periphery on pierced hole | Production of sticking during annealing | Production of gases | Production of fine inner cracks |
|---|---|---|---|---|---|
| 12 | 8 | X | Δ | X | Produced |

As is clear from the above description and Table 6, the above-mentioned Fe-Ni alloy sheet had a chemical composition within the scope of the present invention except that the Fe-Ni alloy sheet contained manganese (Mn) which was not contained in the Fe-Ni alloy sheet of the present invention. In addition, the above-mentioned Fe-Ni alloy sheet had a high Si segregation rate outside the scope of the present invention. As a result, the above-mentioned Fe-Ni alloy sheet required a large amount of surface scarfing, and showed the etching piercing defect, in which the surface of the hole pierced by the etching was roughened to present a blurred periphery, with the production of sticking of the flat masks during the annealing thereof, and furthermore, much gases were produced.

The above-mentioned Fe-Ni alloy sheet was manufactured from the Fe-Ni alloy having the same chemical composition as that in the prior art 1 by means of the same process as in the prior art 1. As is clear from the above description, the excellent effects of the present invention were not available from the prior art 1.

EXAMPLE 4

An Invar alloy ingot, outside the scope of the present invention and comprising 35.7 wt.% nickel, 0.005 wt.% boron, 0.05 wt.% silicon, 0.005 wt.% aluminum, 0.004 wt.% carbon, 0.0018 wt.% nitrogen, 0.002 wt.% sulfur, 0.0026 wt.% oxygen, 0.003 wt.% phosphorus and the balance of iron, was scarfed, then heated to a temperature of 1,250° C., then hot-forged at a sectional reduction rate of 78%, and then subjected to a soaking treatment by heating to a temperature of 1,100° C. for five hours to prepare a slab. The thus prepared slab was subjected to a process identical with that in the Example 1 to prepare an Fe-Ni alloy sheet for a shadow mask having a thickness of 0.20 mm.

For the above-mentioned slab, the production of surface flaws was investigated. For the thus prepared Fe-Ni alloy sheet, the production of fine inner cracks, the silicon (Si) segregation rate in the surface portion of the Fe-Ni alloy sheet, etching pierceability, sticking of the flat masks during the annealing thereof, and the production of gases from the surface of the shadow mask during the operation of the color cathode-ray tube were investigated. These investigations were carried out in the same manner as in the Example 1. The results are shown in Table 7.

TABLE 7

| Si segregation rate (%) | Production of surface flaws | Amount of surface scarfing (mm) | Production of blurred periphery on pierced hole | Production of sticking during annealing | Production of gases | Production of fine inner cracks |
|---|---|---|---|---|---|---|
| 12 | X | 15 | X | Δ | X | Produced |

As is clear from the above description and Table 7, the above-mentioned Fe-Ni alloy sheet had a chemical composition outside the scope of the present invention. In addition, the above-mentioned Fe-Ni alloy sheet had a high Si segregation rate outside the scope of the present invention. As a result, the above-mentioned Fe-Ni alloy sheet required a large amount of surface scarfing, and showed the etching piercing defect, in which the surface of the hole pierced by the etching was roughened to present a blurred periphery, with the production of sticking of the flat masks during the annealing thereof, and furthermore, much gases were produced.

The above-mentioned Fe-Ni alloy sheet was manufactured from the Fe-Ni alloy having the same chemical composition as that in the prior art 2 by means of the same process as in the prior art 2. As is clear from the above description, the excellent effects of the present invention were not available from the prior art 2.

According to the present invention, as described above in detail, it is possible to provide an Fe-Ni alloy sheet for a shadow mask, which suffers from the production of only a few surface flaws, is free from irregularities in the diameter and the shape of the holes pierced by the etching, free from the blurred periphery of the holes, and free from the sticking of the flat masks during the annealing thereof, and produces little gases, and a method for manufacturing same, thus providing industrially useful effects.

What is claimed is:

1. An Fe-Ni alloy sheet for a shadow mask excellent in etching pierceability, preventing sticking during annealing, and inhibiting production of gases, which consists essentially of:

| | |
|---|---|
| nickel (Ni) | from 34 to 38 wt. %, |
| silicon (Si) | from 0.01 to 0.09 wt. %, |
| aluminum (Al) | from 0.002 to 0.020 wt. %, |
| calcium (Ca) | from 0.0002 to 0.0020 wt. %, |
| magnesium (Mg) | from 0.0003 to 0.0020 wt. %, |
| where, Ca + ½ Mg | from 0.0005 to 0.0025 wt. %, |

and the balance being iron and incidental impurities, where, the contents of carbon (C), nitrogen (N), sulfur (S), oxygen (0) and phosphorus (P) as said incidental impurities being respectively:

up to 0.0050 wt.% for carbon, up to 0.0020 wt.% for nitrogen, up to 0.0020 wt.% for sulfur, up to 0.0040 wt.% for oxygen, and up to 0.0040 wt.% for phosphorus, where, $1/10\ C+1/10\ N+S+1/5\ O+\frac{1}{2}\ P$: up to 0.0045 wt.%, and $Ca+\frac{1}{2}\ Mg \geqq S+1/5\ O$; and a surface portion of said Fe-Ni alloy sheet having a silicon (Si) segregation rate, as expressed by the following formula, of up to 10%:

$$\left|\frac{\left(\begin{matrix}\text{Si concentration in}\\ \text{segregation region}\end{matrix}\right)-\left(\begin{matrix}\text{average Si}\\ \text{concentration}\end{matrix}\right)}{(\text{Average si concentration})}\right| \times 100.$$

2. An Fe-Ni alloy sheet for a shadow mask excellent in etching pierceability, preventing sticking during annealing, and inhibiting production of gases, which consists essentially of:

| | |
|---|---|
| nickel (Ni) | from 34 to 38 wt. %, |
| silicon (Si) | from 0.01 to 0.09 wt. %, |
| aluminum (Al) | from 0.002 to 0.020 wt. %, |
| calcium (Ca) | from 0.0002 to 0.0020 wt. %, |
| magnesium (Mg) | from 0.0003 to 0.0020 wt. %, |
| where, Ca + ½ Mg | from 0.0005 to 0.0025 wt. %, |

and the balance being iron and incidental impurities, where, the contents of carbon (C), nitrogen (N), sulfur (S), oxygen (O), phosphorus (P) and non-metallic inclusions as said incidental impurities being respectively:

up to 0.0050 wt.% for carbon, up to 0.0020 wt.% for nitrogen, up to 0.0020 wt.% for sulfur, up to 0.0040 wt.% for oxygen, up to 0.0040 wt.% for phosphorus, and up to 0.0040 wt.% as converted into oxygen for non-metallic inclusions, where, $1/10\ C+1/10\ N+S+1/5\ O+\frac{1}{2}\ P$: up to 0.0045 wt.%, and $Ca+\frac{1}{2}\ Mg \geqq S+1/5\ O$;

said non-metallic inclusions as said incidental impurities comprising a composition having a particle size of up to 6 μm in a region of a melting point of at least 1,600° C., which region is defined by a liquidus curve of 1,600° C. in the $CaO\text{-}Al_2O_3\text{-}MgO$ ternary phase diagram; and a surface portion of said Fe-Ni alloy sheet having a silicon (Si) segregation rate, as expressed by the following formula, of up to 10%:

$$\left|\frac{\left(\begin{matrix}\text{Si concentration in}\\ \text{segregation region}\end{matrix}\right)-\left(\begin{matrix}\text{average Si}\\ \text{concentration}\end{matrix}\right)}{(\text{Average si concentration})}\right| \times 100.$$

3. A method for manufacturing an Fe-Ni alloy sheet for a shadow mask excellent in etching pierceability, preventing sticking during annealing, and inhibiting production of gases, which comprises the steps of:

preparing an ingot or a continuously cast slab of an Fe-Ni alloy consisting essentially of:

| | |
|---|---|
| nickel (Ni) | from 34 to 38 wt. %, |
| silicon (Si) | from 0.01 to 0.09 wt. %, |
| aluminum (Al) | from 0.002 to 0.020 wt. %, |

-continued

| | |
|---|---|
| calcium (Ca) | from 0.0002 to 0.0020 wt. %, |
| magnesium (Mg) | from 0.0003 to 0.0020 wt. %, |
| where, Ca + ½ Mg | from 0.0005 to 0.0025 wt. %, |

and the balance being iron and incidental impurities, where, the contents of carbon (C), nitrogen (N), sulfur (S), oxygen (O) and phosphorus (P) as said incidental impurities being respectively:

up to 0.0050 wt.% for carbon, up to 0.0020 wt.% for nitrogen, up to 0.0020 wt.% for sulfur, up to 0.0040 wt.% for oxygen, and up to 0.0040 wt.% for phosphorus, where, 1/10 C+1/10 N+S+1/5 O+½ P: up to 0.0045 wt.%, and Ca+½ Mg≧S+1/5 O;

subjecting said ingot or said continuously cast slab to a slabbing rolling, a scarfing, a hot rolling, a descaling, another scarfing, at least one cold rolling accompanied by a recrystallization annealing, a temper rolling and a stress-relieving annealing in this order to prepare a sheet of said Fe-Ni alloy;

heating said ingot or said continuously cast slab, when subjecting same to said slabbing rolling, in a heating atmosphere having a hydrogen sulfide ($H_2S$) concentration of up to 100 ppm to a temperature (T)(° C.) within a range of from 1,150° to 1,300° C. for a period of time (t)(hr) as expressed by the following formula:

$$7.71-5.33\times10^{-3}T\leqq\log t\leqq8.00-5.33\times10^{-3}T,$$

then, subjecting same to said slabbing rolling at a sectional reduction rate of at least 35%, and then slowly cooling same, thereby adjusting a silicon (Si) segregation rate, as expressed by the following formula, of a surface portion of said Fe-Ni alloy sheet to up to 10%:

$$\left|\frac{\left(\begin{matrix}\text{Si concentration in}\\ \text{segregation region}\end{matrix}\right)-\left(\begin{matrix}\text{average Si}\\ \text{concentration}\end{matrix}\right)}{\text{(Average si concentration)}}\right|\times 100.$$

4. A method for manufacturing an Fe-Ni alloy sheet for a shadow mask excellent in etching pierceability, preventing sticking during annealing, and inhibiting production of gases, which comprises the steps of:

preparing an ingot or a continuously cast slab of an Fe-Ni alloy consisting essentially of:

| | |
|---|---|
| nickel (Ni) | from 34 to 38 wt. %, |
| silicon (Si) | from 0.01 to 0.09 wt. %, |
| aluminum (Al) | from 0.002 to 0.020 wt. %, |
| calcium (Ca) | from 0.0002 to 0.0020 wt. %, |
| magnesium (Mg) | from 0.0003 to 0.0020 wt. %, |
| where, Ca + ½ Mg | from 0.0005 to 0.0025 wt. %, |

and the balance being iron and incidental impurities, where, the contents of carbon (C), nitrogen (N), sulfur (S), oxygen (O), and phosphorus (P) as said incidental impurities being respectively:

up to 0.0050 wt.% for carbon, up to 0.0020 wt.% for nitrogen, up to 0.0020 wt.% for sulfur, up to 0.0040 wt.% for oxygen, and up to 0.0040 wt.% for phosphorus, where, 1/10 C+1/10 N+S+1/5 O+½ P: up to 0.0045 wt.%, and Ca+½ Mg≧S+1/5 O;

subjecting said ingot or said continuously cast slab to a slabbing rolling, a scarfing, a hot rolling, a descaling, another scarfing, at least one cold rolling accompanied by a recrystallization annealing, a temper rolling and a stress-relieving annealing in this order to prepare a sheet of said Fe-Ni alloy;

heating said ingot or said continuously cast slab, when subjecting same to said slabbing rolling, in a heating atmosphere having a hydrogen sulfide ($H_2S$) concentration of up to 100 ppm to a temperature (T) (° C.) within a range of from 1,150° to 1,300° C. for a period of time (t)(hr) as expressed by the following formula:

$$7.40-5.33\times10^{-3}T\leqq\log t\leqq7.71-5.33\times10^{-3}T,$$

then, subjecting same to a primary slabbing rolling as part of said slabbing rolling at a sectional reduction rate within a range of from 20 to 70%, then heating same again in a heating atmosphere having a hydrogen sulfide ($H_2S$) concentration of up to 100 ppm to a temperature (T)(° C.) within a range of from 1,150° to 1,300° C. for a period of time (t)(hr) as expressed by the above-mentioned formula, then subjecting same to a secondary slabbing rolling as part of said slabbing rolling at a sectional reduction rate within a range of from 20 to 70%, and then slowly cooling same, thereby adjusting a silicon (Si) segregation rate, as expressed by the following formula, of a surface portion of said Fe-Ni alloy sheet to up to 10%:

$$\left|\frac{\left(\begin{matrix}\text{Si concentration in}\\ \text{segregation region}\end{matrix}\right)-\left(\begin{matrix}\text{average Si}\\ \text{concentration}\end{matrix}\right)}{\text{(Average si concentration)}}\right|\times 100.$$

5. A method for manufacturing an Fe-Ni alloy sheet for a shadow mask excellent in etching pierceability, preventing sticking during annealing, and inhibiting production of gases, which comprises the steps of:

preparing an ingot or a continuously cast slab of an Fe-Ni alloy consisting essentially of:

| | |
|---|---|
| nickel (Ni) | from 34 to 38 wt. %, |
| silicon (Si) | from 0.01 to 0.09 wt. %, |
| aluminum (Al) | from 0.002 to 0.020 wt. %, |
| calcium (Ca) | from 0.0002 to 0.0020 wt. %, |
| magnesium (Mg) | from 0.0003 to 0.0020 wt. %, |
| where, Ca + ½ Mg | from 0.0005 to 0.0025 wt. %, |

and the balance being iron and incidental impurities, where, the contents of carbon (C), nitrogen (N), sulfur (S), oxygen (O), phosphorus (P) and non-metallic inclusions as said incidental impurities being respectively:

up to 0.0050 wt.% for carbon, up to 0.0020 wt.% for nitrogen, to 0.0020 wt.% for sulfur, up to 0.0040 wt.% for oxygen, up to 0.0040 wt.% for phosphorus, and up to 0.0040 wt.% as converted into oxygen for non-metallic inclusions, where, 1/10 C+1/10 N+S+1/5 O+½ P: up to 0.0045 wt.%, and Ca+½ Mg≧S+1/5 O;

said non-metallic inclusions as said incidental impurities comprising a composition having a particle size of up to 6 μm in a region of a melting point of at least 1,600° C., which region is defined by a liquidus curve of 1,600° C. in the $CaO-Al_2O_3-MgO$ ternary phase diagram;

subjecting said ingot or said continuously cast slab to a slabbing rolling, a scarfing, a hot rolling, a descaling, another scarfing, at least one cold rolling accompanied by a recrystallization annealing, a temper rolling and a stress-relieving annealing in this order to prepare a sheet of said Fe-Ni alloy;

heating said ingot or said continuously cast slab, when subjecting same to said slabbing rolling, in a heating atmosphere having a hydrogen sulfide ($H_2S$) concentration of up to 100 ppm to a temperature (T)(° C) within a range of from 1,150° to 1,300° C. for a period of time (t)(hr) as expressed by the following formula:

$$7.71-5.33\times10^{-3}T \leqq \log t \leqq 8.00-5.33\times10^{-3}T,$$

then, subjecting same to said slabbing rolling at a sectional reduction rate of at least 35%, and then slowly cooling same, thereby adjusting a silicon (Si) segregation rate, as expressed by the following formula, of a surface portion of said Fe-Ni alloy sheet to up to 10%:

$$\left|\frac{\left(\begin{array}{c}\text{Si concentration in}\\ \text{segregation region}\end{array}\right)-\left(\begin{array}{c}\text{average Si}\\ \text{concentration}\end{array}\right)}{\text{(Average si concentration)}}\right|\times 100.$$

6. A method for manufacturing an Fe-Ni alloy sheet for a shadow mask excellent in etching pierceability, preventing sticking during annealing, and inhibiting production of gases, which comprises the steps of:

preparing an ingot or a continuously cast slab of an Fe-Ni alloy consisting essentially of:

| | |
|---|---|
| nickel (Ni) | from 34 to 38 wt. %, |
| silicon (Si) | from 0.01 to 0.09 wt. %, |
| aluminum (Al) | from 0.002 to 0.020 wt. %, |
| calcium (Ca) | from 0.0002 to 0.0020 wt. %, |
| magnesium (Mg) | from 0.0003 to 0.0020 wt. %, |
| where, Ca + ½ Mg | from 0.0005 to 0.0025 wt. %, |

and the balance being iron and incidental impurities, where, the contents of carbon (C), nitrogen (N), sulfur (S), oxygen (O), phosphorus (P) and nonmetallic inclusions as said incidental impurities being respectively:

up to 0.0050 wt.% for carbon, up to 0.0020 wt.% for nitrogen, up to 0.0020 wt.% for sulfur, up to 0.0040 wt.% for oxygen, up to 0.0040 wt.% for phosphorus, and up to 0.0040 wt.% as converted into oxygen for non-metallic inclusions, where, 1/10 C+1/10 N+S+1/5 O+½ P: up to 0.0045 wt.%, and Ca+½ Mg≧S+1/5 O;

said non-metallic inclusions as said incidental impurities comprising a composition having a particle size of up to 6 μm in a region of a melting point of at least 1,600° C., which region is defined by a liquidus curve of 1,600° C. in the $CaO-Al_2O_3-MgO$ ternary phase diagram;

subjecting said ingot or said continuously cast slab to a slabbing rolling, a scarfing, a hot rolling, a descaling, another scarfing, at least one cold rolling accompanied by a recrystallization annealing, a temper rolling and a stress-relieving annealing in this order to prepare a sheet of said Fe-Ni alloy;

heating said ingot or said continuously cast slab, when subjecting same to said slabbing rolling, in a heating atmosphere having a hydrogen sulfide ($H_2S$) concentration of up to 100 ppm to a temperature (T)(° C.) within a range of from 1,150° to 1,300° C. for a period of time (t)(hr) as expressed by the following formula:

$$7.40-5.33\times10^{-3}T \leqq \log t \leqq 7.71-5.33\times10^{-3}T,$$

then subjecting same to a primary slabbing rolling as part of said slabbing rolling at a sectional reduction rate within a range of from 20 to 70%, then heating same again in a heating atmosphere having a hydrogen sulfide ($H_2S$) concentration of up to 100 ppm to a temperature (T)(° C.) within a range of from 1,150° to 1,300° C. for a period of time (t)(hr) as expressed by the above-mentioned formula, then subjecting same to a secondary slabbing rolling as part of said slabbing rolling at a sectional reduction rate within a range of from 20 to 70%, and then slowly cooling same, thereby adjusting a silicon (Si) segregation rate, as expressed by the following formula, of a surface portion of said Fe-Ni alloy sheet to up to 10%:

$$\left|\frac{\left(\begin{array}{c}\text{Si concentration in}\\ \text{segregation region}\end{array}\right)-\left(\begin{array}{c}\text{average Si}\\ \text{concentration}\end{array}\right)}{\text{(Average si concentration)}}\right|\times 100.$$

* * * * *

UNITED STATES PATENT AND TRADEMARK OFFICE

CERTIFICATE OF CORRECTION

PATENT NO. : 5,234,512

DATED : August 10, 1993

INVENTOR(S) : INOUE et al

It is certified that error appears in the above-identified patent and that said Letters Patent is hereby corrected as shown below:

Column 32, line 66, before "to" insert --up--.

Signed and Sealed this

Sixth Day of December, 1994

Bruce Lehman

*Attest:*

BRUCE LEHMAN

*Attesting Officer*

*Commissioner of Patents and Trademarks*